US007720428B2

(12) United States Patent
Hagi et al.

(10) Patent No.: US 7,720,428 B2
(45) Date of Patent: May 18, 2010

(54) TONER RECOVERY APPARATUS, PROCESS CARTRIDGE, AND IMAGE FORMING APPARATUS

(75) Inventors: Masayuki Hagi, Minoo (JP); Yoshihiro Mikuriya, Nishinomiya (JP); Yoshitaka Sekiguchi, Nishinomiya (JP); Hideaki Yasunaga, Ibaraki (JP); Hiroaki Kato, Nagaokakyo (JP); Kazuoki Fuwa, Toyonaka (JP); Masahide Inoue, Numazu (JP); Yoshiyuki Shimizu, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 12/017,617

(22) Filed: Jan. 22, 2008

(65) Prior Publication Data

US 2008/0199234 A1 Aug. 21, 2008

(30) Foreign Application Priority Data

Jan. 22, 2007 (JP) ..... 2007-011057

(51) Int. Cl.
*G03G 21/10* (2006.01)
*G03G 21/16* (2006.01)

(52) U.S. Cl. ..... 399/360

(58) Field of Classification Search ..... 399/120, 399/123, 264, 343, 358, 359, 360; 430/108.7, 430/111.4

See application file for complete search history.

(56) References Cited

U.S. PATENT DOCUMENTS 7,424,263 B2 9/2008 Shimizu et al.
7,577,377 B2 * 8/2009 Miyamoto et al. ..... 399/111
2006/0204882 A1 9/2006 Nozaki et al.
2006/0210902 A1 9/2006 Nakamura et al.

(Continued)

FOREIGN PATENT DOCUMENTS

JP 8-15971 1/1996

(Continued)

OTHER PUBLICATIONS

U.S. Appl. No. 12/197,651, filed Aug. 25, 2008, Katoh, et al.

(Continued)

*Primary Examiner*—David P Porta
*Assistant Examiner*—David S Baker
(74) *Attorney, Agent, or Firm*—Oblon, Spivak, McClelland, Maier & Neustadt, L.L.P.

(57) ABSTRACT

To provide a toner recovery apparatus including: a toner transporting duct; and an endless toner transporting belt; wherein the toner transporting belt is rotated in a loop form in such a way that it descends in a region where the outer circumferential surface faces a ceiling surface of the toner transporting duct and that it rises in a region where the outer circumferential surface of the toner transporting belt faces a bottom surface of the toner transporting duct, the toner recovery apparatus transports the residual toner to the outlet by holding the toner by the convex parts, spaces formed between convex parts and the bottom surface of the toner transporting duct, and the toner comprises a binding resin, releasing agent, coloring material and external additive, and torque T (mNm) measured by torque measurement method using a conical rotor in a space ratio of 50% to 60% is 1.0 to 2.5.

13 Claims, 7 Drawing Sheets

U.S. PATENT DOCUMENTS

| | | | |
|---|---|---|---|
| 2006/0268373 | A1 | 11/2006 | Tatsumi et al. |
| 2006/0275686 | A1 | 12/2006 | Kadota et al. |
| 2006/0292474 | A1 | 12/2006 | Mikuriya et al. |
| 2007/0026335 | A1 | 2/2007 | Yamamoto et al. |
| 2007/0059625 | A1 | 3/2007 | Yamamoto et al. |
| 2007/0104523 | A1 | 5/2007 | Yoshida et al. |
| 2007/0122729 | A1 | 5/2007 | Katoh et al. |
| 2007/0148568 | A1 | 6/2007 | Kadota et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0238042 | A1 | 10/2007 | Yasunaga et al. |
| 2007/0248390 | A1 | 10/2007 | Kubota et al. |
| 2008/0019720 | A1 | 1/2008 | Kawakami et al. |
| 2008/0038656 | A1 | 2/2008 | Yasunaga et al. |
| 2008/0089727 | A1* | 4/2008 | Shimizu et al. ..... 399/360 |
| 2008/0095557 | A1* | 4/2008 | Horie ..... 399/329 |
| 2008/0267661 | A1* | 10/2008 | Yoshida et al. ..... 399/120 |
| 2008/0304875 | A1* | 12/2008 | Katoh et al. ..... 399/286 |
| 2009/0022531 | A1* | 1/2009 | Kubota et al. ..... 399/359 |
| 2009/0142094 | A1* | 6/2009 | Sawada et al. ..... 399/111 |
| 2009/0154973 | A1* | 6/2009 | Shimizu et al. ..... 399/358 |
| 2009/0169270 | A1* | 7/2009 | Fuwa et al. ..... 399/279 |
| 2009/0232559 | A1* | 9/2009 | Ushikubo ..... 399/264 |

FOREIGN PATENT DOCUMENTS

| | | |
|---|---|---|
| JP | 3281595 | 2/2002 |
| JP | 2007-171421 | 7/2007 |

OTHER PUBLICATIONS

U.S. Appl. No. 12/241,656, filed Sep. 30, 2008, Yasunaga, et al.

* cited by examiner

TONER RECOVERY APPARATUS, PROCESS CARTRIDGE, AND IMAGE FORMING APPARATUS

BACKGROUND OF THE INVENTION

1. Field of the Invention

The present invention relates to a toner recovery apparatus, a process cartridge, and an image forming apparatus, which are used for the formation of an electrophotographic image in an electrostatic copier, a laser printer, and the like.

2. Description of the Related Art

Recent demands for compact, high-speed, and low-cost electrostatic copiers and laser beam printers have prompted the development of compact, low-cost, and high-speed printers that are designed particularly for use in a small office or home office and for individual users.

Along with such a trend, full color laser printers that employ a tandem development system and an intermediate transfer method system are being predominated. Various makers have tried to downsize the integral process cartridge or the printer machine itself by devising the position or layout of the cartridge in the main body.

An example of a method for downsizing a process cartridge is to integrate all of the cartridge units including a toner hopper, a development unit, a cleaning unit, and a recovery unit for recovering a residual toner (hereinafter referred to as "waste toner"), and as one example of the configuration for downsizing the main body, various makers have marketed machines in which an intermediate transfer belt is placed horizontally and an integral process cartridge is disposed above the belt.

Particularly, in the case of such a main body configuration, since a transfer belt is disposed below a process cartridge, the physical relationship of units in the process cartridge will necessary be such that the developing and transferring unit is placed at the lowest part of the process cartridge and a toner hopper part (including a toner replenishing/stirring mechanism, and the like) and a waste toner recovery part are placed over the developing and transferring unit. If aiming at downsizing of a main body with such a configuration, the integral cartridge is designed so as to arrange the developing unit, hopper unit and waste toner recovery part in a vertical direction to minimize the area where the cartridge is disposed.

On the other hand, there have been conventionally proposed various means of transporting and collecting a waste toner removed in a cleaning part to a recovery unit, and a toner transfer method using a toner transporting belt has been proposed particularly as a waste toner recovery mechanism for a process cartridge with consideration of downsizing and cost reduction.

For example, Japanese Patent (JP-B) No. 3281595 describes a toner recovery apparatus as described below. That is, a process cartridge is provided with an endless groove in the side flame thereof, a side plate is fixed to the surface of the side frame formed with the groove in such a way that the groove is covered with this side plate, whereby a toner transporting duct is defined. This toner transporting duct is designed to have in the lower part thereof an inlet through which a waste toner enters from a cleaning unit, and this inlet is provided with a connection hole to communicate with the cleaning unit. Further, the toner transporting duct is designed to have in the upper part thereof an outlet provided with a connection hole to communicate with the toner recovery part. In addition, an endless toner transporting belt provided with a plurality of convex parts on the outer circumferential surface is housed so as to be rotatable along the groove. By rotating this toner transporting belt, a waste toner transported into the inlet from the cleaning unit is drawn up with the convex parts on the toner transporting belt, to transport in the outlet placed in apart above the inlet. The waste toner discharged by the toner transporting belt is collected in the toner recovery part by falling down into the toner recovery part from the outlet unit.

In Japanese Patent Application Laid-Open (JP-A) No. 08-15971, a toner transporting duct similar to the above described one is formed on a side surface of a process cartridge, which duct is defined by a waste toner transporting member and is gently inclined at an angle of about 30 degrees. This toner transporting duct is designed to have in the lower part thereof an inlet through which a waste toner enters from the cleaning unit, and this inlet is provided with a connection hole to communicate with the cleaning unit. Further, the toner transporting duct is designed to have in the upper part thereof an outlet provided with a connection hole to communicate with the toner recovery part. An endless waste toner transporting belt provided with a plurality of convex parts on the outer circumferential surface is provided in this toner transporting duct so as to freely rotate, and the waste toner transported into the inlet from the cleaning unit is transported toward the outlet while being scraped along with the bottom of the toner transporting duct by the convex parts on the toner transporting belt, and is collected in the toner recovery part.

However, the current situation is that the process cartridge with a vertical structure for achieving further reduced size in the above described related art still fails to realize sufficient performance as a waste toner recovery mechanism.

That is, in JP-B No. 3281595, although a waste toner is held against a toner transporting belt for transportation to the outlet, the toner transporting belt is oscillated by oscillation transmitted from a driving part, and the waste toner supported on the belt is spilled down from a gap between convex parts on the belt and the internal wall of the toner transporting duct by its own weight. The amount of the toner supported on the toner transporting belt therefore decreases on the way of toner transportation, whereby the toner transportation efficiency is lowered, and further, the toner particles spilled down still remains inside the transporting duct to cause clogging, thereby preventing rotation of the transporting belt. In JP-A No. 08-15971, the waste toner is transported in the outlet while being scraped along the bottom of the toner transporting duct by convex parts on the transporting belt. While such a transportation form is suitable for a horizontal process cartridge having a transporting duct with a comparatively gentle slope, however, in the case of necessarily taking a structure where the slope of the transporting duct has to be sharp, like a vertical process cartridge, the efficiency of transporting the waste toner disclosed in JP-A No. 08-15971 is insufficient, and in the same way as described in JP-B No. 3281595, there causes a problem where the waste toner on the way of transportation duct is spilled down from a gap between the bottom of the transporting duct and convex parts on the transporting belt.

BRIEF SUMMARY OF THE INVENTION

The present invention was made in view of the above described circumstances, and an object of the present invention is to solve the above described various conventional problems and to achieve the following objects. That is, an object of the present invention is to provide a toner recovery apparatus for transporting a waste toner collected by a cleaning unit to a waste toner recovery part above, wherein toner spillage is suppressed in the toner transporting duet, so as to effectively transport the toner to the recovery unit, a process cartridge, and an image forming apparatus.

The present inventors have repeated intensive studies in order to solve the above problems, as a result, it was found that a residual toner collected in a cleaning part, which is transported to an inlet in the toner transportation route, is supported on a convex part of the toner transporting belt and the bottom of the toner transportation route, and transported to the outlet, by which oscillation on the residual toner after a transferring step on the way of transportation to the outlet can be minimized.

The present invention is to specify powder properties of a residual toner after a transferring step suitable for a transporting method as described above and the constituent elements thereof. The toner recovery apparatus of the present invention has at least a toner replenishing unit, a developing unit, a unit for transferring from an image bearing member to a transferring material, and a unit for cleaning the image bearing member after transferring.

The present invention is on the bases of the above described findings by the present inventors, and means for solving the above problems are as follows:

<1> A toner recovery apparatus including: a toner transporting duct which is provided in a lower portion thereof with an inlet through which a residual toner removed by a cleaning unit is transported and which is provided in an upper portion thereof with an outlet from which the residual toner is sent to a toner recovery part; and an endless toner transporting belt having a plurality of convex parts on an outer circumferential surface thereof, the belt rotatably stretched in the toner transporting duct; wherein the toner recovery apparatus transports the residual toner removed by the cleaning unit to the toner recovery part, the toner transporting belt is rotated in a loop form in such a way that the toner transporting belt descends in a region where the outer circumferential surface of the toner transporting belt faces a ceiling surface of the toner transporting duct, and that the toner transporting belt rises in a region where the outer circumferential surface of the toner transporting belt faces a bottom surface of the toner transporting duct, the toner recovery apparatus transports the residual toner transported through the inlet to the outlet by holding the toner by the convex parts, spaces formed between the convex parts and the bottom surface of the toner transporting duct, and the toner comprises a binding resin, a releasing agent, a coloring material, and an external additive, and a torque T (mNm) measured by a torque measurement method using a conical rotor in a space ratio of 50% to 60% is 1.0 to 2.5.

<2> The toner recovery apparatus according to <1>, wherein the bottom surface of the toner transporting duct is inclined with respect to the horizontal plane at an angle of 40 to 85 degrees.

<3> The toner recovery apparatus according one of <1> and <2>, further including in the toner transporting duct a driving roller and a driven roller, wherein the toner transporting belt is stretched between the driving roller and the driven roller.

<4> The toner recovery apparatus according to <3>, wherein the driving roller is provided with convex parts, and the convex parts are engaged with the toner transporting belt so that the toner transporting belt is driven to rotate.

<5> The toner recovery apparatus according to <4>, wherein the toner transporting belt is provided with porous parts or notched parts, and the convex parts of the driving roller are engaged with the porous parts or the notched parts.

<6> The toner recovery apparatus according to <5>, further including in the outlet a scraper member for scraping the residual toner transported from the toner transporting belt.

<7> The toner recovery apparatus according any one of <1> to <6>, wherein the toner has an average particle diameter of 5 μm to 10 μm and a circularity of 0.89 to 0.97, and the toner contains a releasing agent having a melting point of 65° C. to 90° C. in an amount of 3 parts by mass to 10 parts by mass, and at least two kinds of inorganic particles added as an external additive.

<8> The toner recovery apparatus according to any one of <1> to <7>, wherein the external additive comprises a hydrophobic silica particle A having a BET specific surface area of more than 100 $m^2/g$, and a hydrophobic silica particle B having a BET specific surface area of 30 $m^2/g$ to 100 $m^2/g$.

<9> The toner recovery apparatus according to <8>, wherein the total amount of the silica particle A and the silica particle B added is 2.5 parts by mass or more per 100 parts by mass of a toner base particle, and the amount of the silica particle B is larger than the amount of the silica particle A in the toner.

<10> A process cartridge including: a latent electrostatic image bearing member for bearing thereon a latent electrostatic image; a toner recovery unit configured to transport residual toner of the one-component nonmagnetic toner removed by a cleaning unit to a recovery unit; at least one unit configured to be supported integrally with a developing device; and a toner recovery apparatus; wherein the process cartridge is detachably mounted to an image forming apparatus that forms an image by visualizing a latent electrostatic image formed on a latent electrostatic bearing member by use of a one-component nonmagnetic toner, and wherein the toner recovery apparatus is the toner recovery apparatus according to any one of <1> to <10>.

<11> The process cartridge according to claim <10>, wherein the toner transporting duct is provided in a side surface of the process cartridge.

<12> The process cartridge according to one of <10> and <11>, wherein the toner recovery part has a vertical structure and is provided at a position higher than the developing device.

<13> An image forming apparatus, including: a latent electrostatic image bearing member for bearing thereon a latent electrostatic image; a developing device configured to form a toner image by visualizing the latent electrostatic image using a mono-component nonmagnetic toner; a charging unit configured to charge the latent electrostatic image bearing member; an exposure unit configured to form a latent electrostatic image on the charged latent electrostatic image bearing member, a transfer unit configured to transfer a toner image formed by the developing device to a recording medium; a cleaning unit configured to remove residual toner of the mono-component nonmagnetic toner from the latent electrostatic image bearing member; a toner recovery unit configured to transport the residual toner removed by the cleaning unit to a toner recovery part; and the toner recovery apparatus according to any one of <1> to <9>.

<14> An image forming apparatus including the process cartridge according to any one of <10> to <12>.

According to these solving means, the toner recovery apparatus of the present invention can reduce oscillation effect of the toner transporting belt, and thus can prevent occurrence of toner spillage, in contrast to a toner recovery apparatus where waste toner is carried on the toner transporting belt.

The process cartridge and the image forming apparatus of the present invention can prevent toner spillage at the time of transporting the waste toner. Further, particularly in the case of necessarily taking a structure in which the slope of a transporting duct is sharp as in a vertical process cartridge, even when the slope of the transporting duct of the toner collected is sharp, spillage is prevented, thereby there is a room for machine design, which results in that a machine can be downsized.

DETAILED DESCRIPTION OF THE INVENTION

Hereinafter, the best mode for carrying out the present invention will be explained in reference to the drawings. In addition, so-called a skilled person in the art easily changes and modifies the present invention within the scope of the claims to form other embodiments, and these changes and modifications are included within the scope of the claims. The following description is an example of the best mode in the present invention, and does not intend to limit these claims.

As an image forming apparatus applied to the present invention, one embodiment of an electrophotographic printer (hereinafter, simply referred to as a printer) will be explained below.

Figure 1:
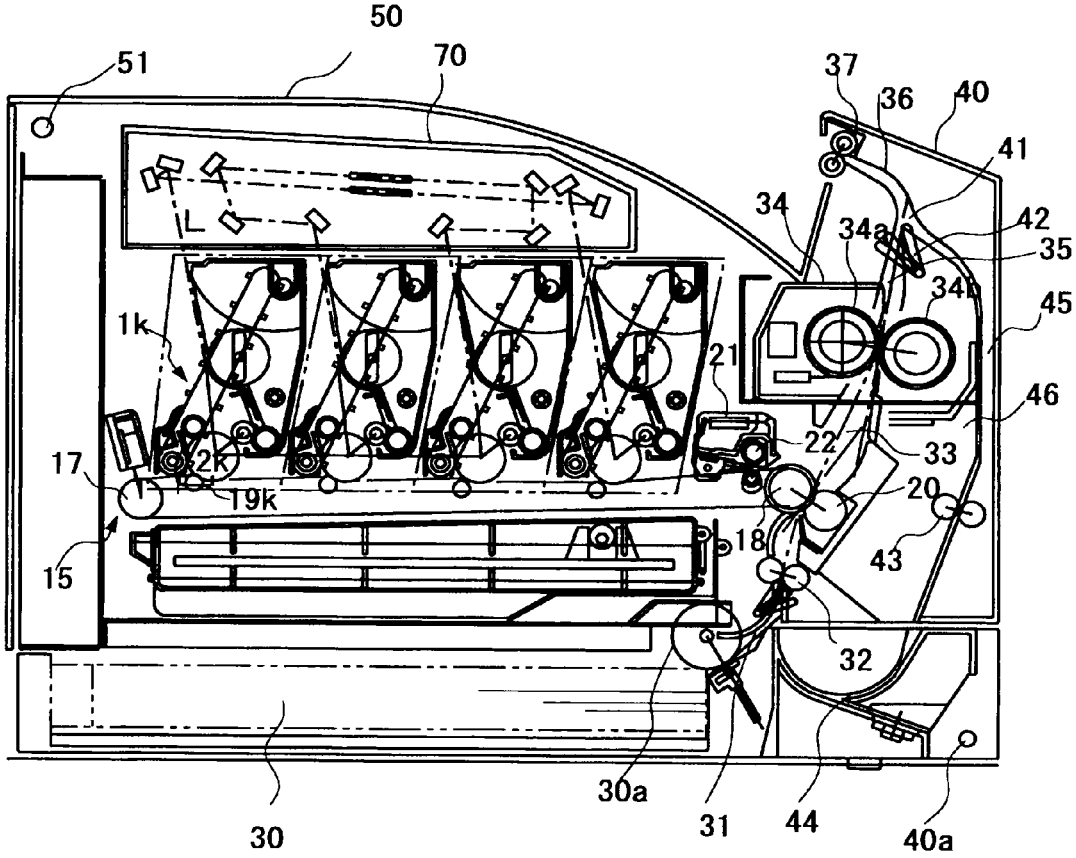
FIG. 1 is a schematic structural view illustrating a printer according to an embodiment.

First, the basic structure of the printer will be explained. FIG. 1 is a schematic structural view illustrating the printer. In this figure, in order to form toner images of yellow, magenta, cyan, and black (hereinafter referred to as Y, M, C, and K), this printer is provided with four process cartridges 1 for Y, M, C, and K. These process cartridges respectively use different colors of Y, M, C, K toners as image forming substances, but other than this respect, they have the same components and are replaced at the time when their lifespan is over. In the following explanation, since respective cartridges 1 for Y, C, M, and K, all have the same components, reference symbols for color identification, Y, C, M, and K are omitted.

As shown in FIG. 1, a drum photoconductor 2 or an image bearing member, a drum cleaning device 3 or a cleaning means, a charge eliminating device (not shown), a charge device 4, a developing device 5, a toner recovery apparatus 6, and the like are provided. Each process cartridge 1, an image forming unit, is detachable to the printer body, and consumable parts can be replaced at a time.

The charge device 4 charges uniformly on the surface of the photoconductor 2 rotated in clockwise direction in the figure by a driving means (not shown). The surface of the photoconductor 2 uniformly charged supports a latent electrostatic image by exposure scanning with a laser light L. This latent electrostatic image is developed to be a toner image by the developing device 5 using a toner (not shown). Then, the toner image is subjected to intermediate transferring on an intermediate transfer belt 16 described later. The drum cleaning device 3 removes a residual toner attached to the surface of the photoconductor 2 after the intermediate transferring step. The toner recovery apparatus 6 transports the residual toner to a toner recovery part 7 formed at the upper part of the developing device 5. Further, the charge eliminating device removes residual charge in the photoconductor 2 after cleaning. By this removal of electricity, the surface of the photoconductor 2 is initialized and made ready for next image forming.

The developing device 5 has a vertically long hopper part 5*a* containing a toner (not shown), and a developing part 5*b*. The inside of the hopper part 5*a* is disposed with an agitator 5*c* that is rotationally driven by a driving means (not shown), an stirring paddle 5*d* that is rotationally driven in the lower part in the vertical direction by a driving means (not shown), a toner feeding roller 5*e* that is rotationally driven in the vertical direction by a driving means (not shown), and the like. While a toner inside the hopper part 5*a* is stirred by rotational driving of the agitator 5*c* and the stirring paddle 5*d*, it moves toward the toner feeding roller 5*e* with its own weight. The toner feeding roller be is composed of a core made of a metal and a roller part made of a resin foam, etc coated on the surface thereof, and it is rotated while attaching a toner in the hopper part 5*a* on the surface of the roller part. On the upper part of the hopper part 5*a*, a toner recovery part 7 is disposed, in which the residual toner is contained.

The inside of the developing part 5*b* in the developing device 5 is disposed with a developing roller 5*f* rotating while being in contact with the photoconductor 2 and the toner feeding roller 5*e*, and a thin layered blade 6*g* bringing the edge contact with the surface of the developing roller 5*f*, and the like. The toner attached on the toner feeding roller 5*e* in the hopper part 5*a* is supplied to the surface of the developing roller 5*f* at a portion of being in contact with the developing roller 5*f* and the toner feeding roller 5*e*. A layer thickness of the supplied toner on the roller surface is regulated at the time of passing through the contact position of the developing roller 5*f* and the thin layered blade 5*g* along with rotation of the developing roller 5*f*. The toner after regulating its layer thickness is then attached to a latent electrostatic image on the surface of the photoconductor 2 in a developing region that is the contact portion of the developing roller 5*e* and the photoconductor 2. Due to this attachment, the latent electrostatic image is developed to be a toner image.

In FIG. 1, an optical writing unit 70 is disposed in the upper vertical direction of the process units 1, Y, M, C, and K. The optical writing unit 70, which is a latent image writing device optically scans the photoconductor 2, Y, M, C, and K in the process units 1 for Y, M, C, and K, with a laser light L emitted from a laser diode on the basis of image information. By this light scanning, electrostatic images for Y, M, C, and K are formed on the photoconductors for 2 Y, M, C, and K. In addition, the optical writing unit 70 is to irradiate a photoconductor via a plurality of optical lenses and mirrors while polarizing in the main scanning direction with a polygon mirror rotationally driven by a polygon motor (not shown).

Below the process units 1 for Y, M, C, and K in the vertical direction, an transferring unit 15 is disposed which endlessly rotates an endless intermediate transfer belt 16 in a counterclockwise direction in the figure while stretching it between rollers. The transferring unit 15 to be a transferring unit is provided with, other than the intermediate transfer belt 16, a driving roller 17, a driven roller 18, four primary transfer rollers 19 for Y, M, C, and K, a secondary transfer roller 20, a belt cleaning device 21, a cleaning backup roller 22, and the like.

The intermediate transfer belt 16 is stretched between the driving roller 17, the driven roller 18, the cleaning backup roller 22, and the four primary transfer rollers 19 for Y, M, C, and K, which are disposed inside the loop thereof. Due to rotational force of the driving roller 17 rotationally driving in a counterclockwise direction in the figure by a driving means (not shown), the intermediate transfer belt 16 endlessly moves in the same direction.

The four primary transfer rollers 19 for Y, M, C, and K respectively pinch the intermediate transfer belt 16 in the photoconductors 2 for Y, M, C, and K. Thereby, primary transfer nips for Y, M, C, and K are formed at which the right surface of the intermediate transfer belt 16 is in contact with the photoconductors 2 for Y, M, C, and K.

In the primary transfer rollers 19 for Y, M, C, and K, primary transfer biases are respectively applied by a transfer bias supply (not shown), thereby, the transfer electric field is formed between the electrostatic images of the photoconductors 2 for Y, M, C, and K and the primary transfer rollers 19, Y, M, C, and K. In addition, in place of the primary transfer rollers 19 for Y, M, C, and K, a transfer charger, a transfer brush or the like may be employed.

When a Y toner formed on the surface of the photoconductor 2Y of the process unit 1Y for Y enters the above described primary transfer nip for Y along with rotation of the photoconductor 2Y, due to actions of the transfer electric field and a nip pressure, the Y toner is primarily transferred on the intermediate transfer belt 16 from on the photoconductor 2Y. The intermediate transfer belt 16 on which the Y toner is primarily transferred in this manner is primarily transferred such that M, C, and K toner images on the photoconductors 2, M, C, and K are sequentially superimposed on the Y toner image, at the time of passing through primary transfer nips for M, C, and K along with the endless movement thereof. Due to this superimposing primary transfer, a four-colored toner image is formed on the intermediate transfer belt 16.

The secondary transfer roller 20 in the transferring unit 15 is disposed on the outside of the loop of the intermediate transfer belt 16, and it pinches the intermediate transfer belt 16 in the driven roller 18 inside the loop. By this, a secondary transfer nip at which the right surface of the intermediate transfer belt 16 and the secondary transfer roller 20 are in contact is formed. To the secondary transfer roller 20, the secondary transfer bias is applied by transfer bias supply (not shown). By this application, the secondary transfer electric field is formed between the secondary transfer roller 20 and the driven roller that is ground-connected.

In the lower vertical direction of the transferring unit 15, a paper feed cassette 30 storing recording paper sheets P in a bundle is disposed so as to be slidably detached to the printer housing. In the paper feed cassette 30, a paper feed roller 30*a* is in contact with the upper most recording paper sheet P, and the paper feed roller 30*a* is rotated in a counterclockwise direction in the figure at predetermined timing, thereby, the recording paper sheet P is sent out toward a paper feed route 31.

In the vicinity of the end of the paper feed route 31, a pair of resist rollers 32 are disposed. As soon as a pair of this resist rollers 32 pinches the recording paper sheet P sent out from the paper feed cassette 30 between the rollers, rotation of the rollers is stopped. At a timing when the pinched recording paper sheet P is synchronized with a four-colored toner image on the intermediate transfer belt 16 in the above described secondary transfer nip, rotational driving is resumed, and the recording paper sheet P is sent out toward the secondary transfer nip.

The four-colored toner image on the intermediate transfer belt 16, which is closely attached to the recording paper sheet P with the secondary transfer nip is subjected to secondary transferring on the recording paper sheet P at once, under influence of the secondary transfer electric field and a nip pressure, which results in forming a full color toner image, in cooperation with white color of the recording paper sheet P. The recording paper sheet P having the full color toner image thus formed on the surface is self-stripped from the secondary transfer roller 20 and the intermediate transfer belt 16 when passing through the secondary transfer nip. Then, the recording paper sheet P is sent into a fixing device 34 to be described later via a post transfer transportation route 33.

To the intermediate transfer belt 16 after passing through the secondary transfer nip is attached a residual toner that has not been transferred to the recording paper sheet P. This residual toner is cleaned from the belt surface by a belt cleaning device 21, being in contact with the right surface of the intermediate transfer belt 16. A cleaning backup roller 22 disposed inside the loop of the intermediate transfer belt 16 backs up belt cleaning by the belt cleaning device 21 from the inside of the loop.

The fixing device 34 forms a fixing nip by means of a fixing roller 34*a* containing a heat generation source such as a halogen lamp (not shown) and a pressurizing roller 34*b* rotating while being in contact with the fixing roller 34*a* at a predetermined pressure. The recording paper sheet P sent in the fixing device 34 is pinched by the fixing nip so that an unfixed toner image bearing member surface of the recording paper sheet P is closely attached to the fixing roller 34*a*. The toner in the toner image is then softened due to influence of heating or pressurization, and thus a full color image is fixed.

The recording paper sheet P discharged from the fixing device 34 comes to a diverging point between a paper ejection route 36 and a prior inversion transportation route 41 after passing through a post fixing transportation route 35. In the side of the post fixing transportation route 35, a changeover switch 42 rotationally driven with the center on a turning shaft 42*a* is disposed, and a vicinity of the end of the post fixing transportation route 35 is closed or opened by turning the changeover switch 42. At the timing of sending the recording paper sheet P from the fixing device 34, the changeover switch 42 stops at a turning position shown in a solid line in the figure, and around the edge of the post fixing transportation route 35 is opened. Thus, the recording paper sheet P enters the paper ejection route 36 from the post fixing transportation route 35, and is pinched between a pair of the paper ejection rollers 37.

In the case that a single-side printing mode is set according to control signals sent by operation of an operational unit composed of a numeric keypad (not shown), etc. or sent from a personal computer (not shown), etc., the recording paper sheet P pinched between a pair of the paper ejection rollers 37 is ejected outside the machine as it is. Then, it is stacked to the stack part, which is a surface of the upper cover 50 of the machine housing.

On the other hand, in the case that double-side printing is set, when the rear edge side of the recording paper sheet P transported in the paper ejection route 36 while the front edge thereof is pinched between a pair of the paper ejection rollers 37 passes through the post fixing transportation route 35, the changeover switch 42 turns to close an area near the end of the post fixing transportation route 35. At the almost same time a pair of the paper ejection rollers 37 starts inverse rotation. Then, the recording paper sheet P is transported with directing the rear edge side at the head in this time, and it goes in the prior inversion transportation route 41.

The right edge of the printer is an inversion unit 40 capable of opening and closing to the machine housing by turning with the center on the turning shaft 40*a*. If a pair of the paper ejection rollers 37 inversely rotate, the recording paper sheet P goes inside the prior inversion transportation route 41 in this inversion unit 40, and it is transported toward the lower vertical direction from the upper vertical direction. Then, after passing through between rollers of a pair of inversion transporting rollers 43, the recording paper sheet P goes into the semicircularly curved inversion transportation route 44. Further, with being transported along with the semicircular curve, while the upper surface and the lower surface are inverted, the direction of movement toward the lower vertical direction from the upper vertical direction is inverted, and the recording paper sheet P is transported toward the upper vertical direction from the lower vertical direction. Thereafter, passing through the inside of the above-described paper feed route 31, the recording paper sheet P goes into the secondary transfer nip. Then, after a full color image is secondarily transferred at once on the other side, it is ejected out of the machine sequentially passing through the post transfer transportation route 33, the fixing device 34, the post fixing transportation route 35, the paper ejection route 36, and a pair of the paper ejection rollers 37.

The above described inversion unit 40 has an external cover 45 and an oscillating body 46. Specifically, the external cover 45 in the inversion unit 40 is supported so as to turn about the center on the turning shaft 40*a* provided in a housing of the printer main body. By this turning, the external cover 45, together with the oscillating body 46 contained therein, opens or closes to the housing. When the external cover 45 opens with the oscillating body 46 therein, the paper feed route 31, the secondary transfer nip, the post transfer transportation route 33, the fixing nip, the post fixing transportation route 36, and the paper ejection route 36, which are formed between the inversion unit 40 and the printer main body side, are vertically divided in two to be exposed to external. This makes it possible to easily remove jammed paper in the paper feed route 31, the secondary transfer nip, the post transfer transportation route 33, the fixing nip, the post fixing transportation route 35, and the paper ejection route 36.

The oscillating body 46 is supported by the external cover 45 (not shown) so as to turn about the center on an oscillating shaft provided in the external cover 45, the external cover 45 opened. When the oscillating body 46 opens to the external cover 45 by this turning, the prior inversion transportation route 41 and the inversion transportation route 44 are vertically divided in two to be exposed to external. This makes it possible to easily remove jammed paper in the prior inversion transportation route 41 and the inversion transportation route 44.

The upper cover 50 on the housing of the printer is supported so as to freely turn about the center on the turning shaft 151, as shown in the arrow in the figure, and by rotating in counterclockwise direction in the figure, the upper cover 50 is in a state of opening to the housing. Then, the upper opening in the housing is largely exposed toward external. This allows an optical writing unit 71 to be exposed.

Then, the toner recovery apparatus 6 that is a feature of the printer of the present invention will be specifically described.

Figure 2:
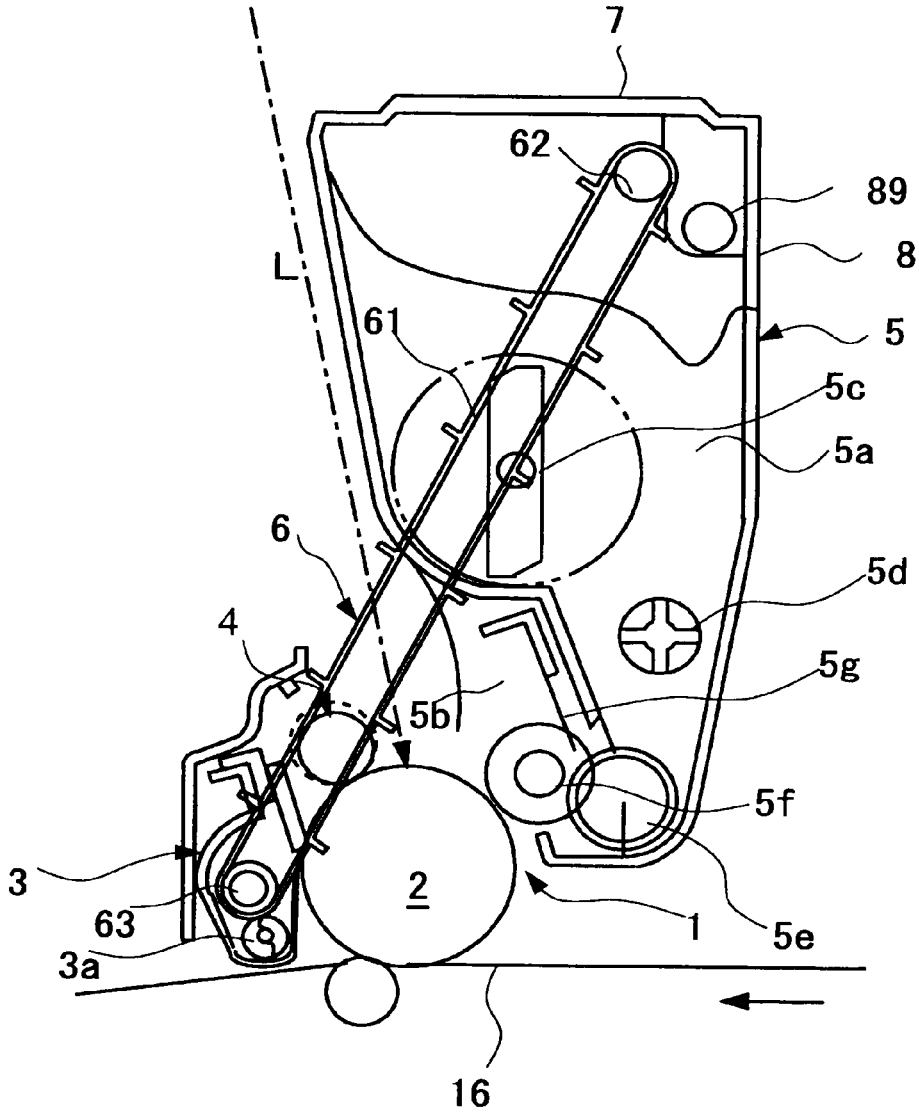
FIG. 2 is a schematic structural view illustrating a process unit of the same printer.
Figure 3:
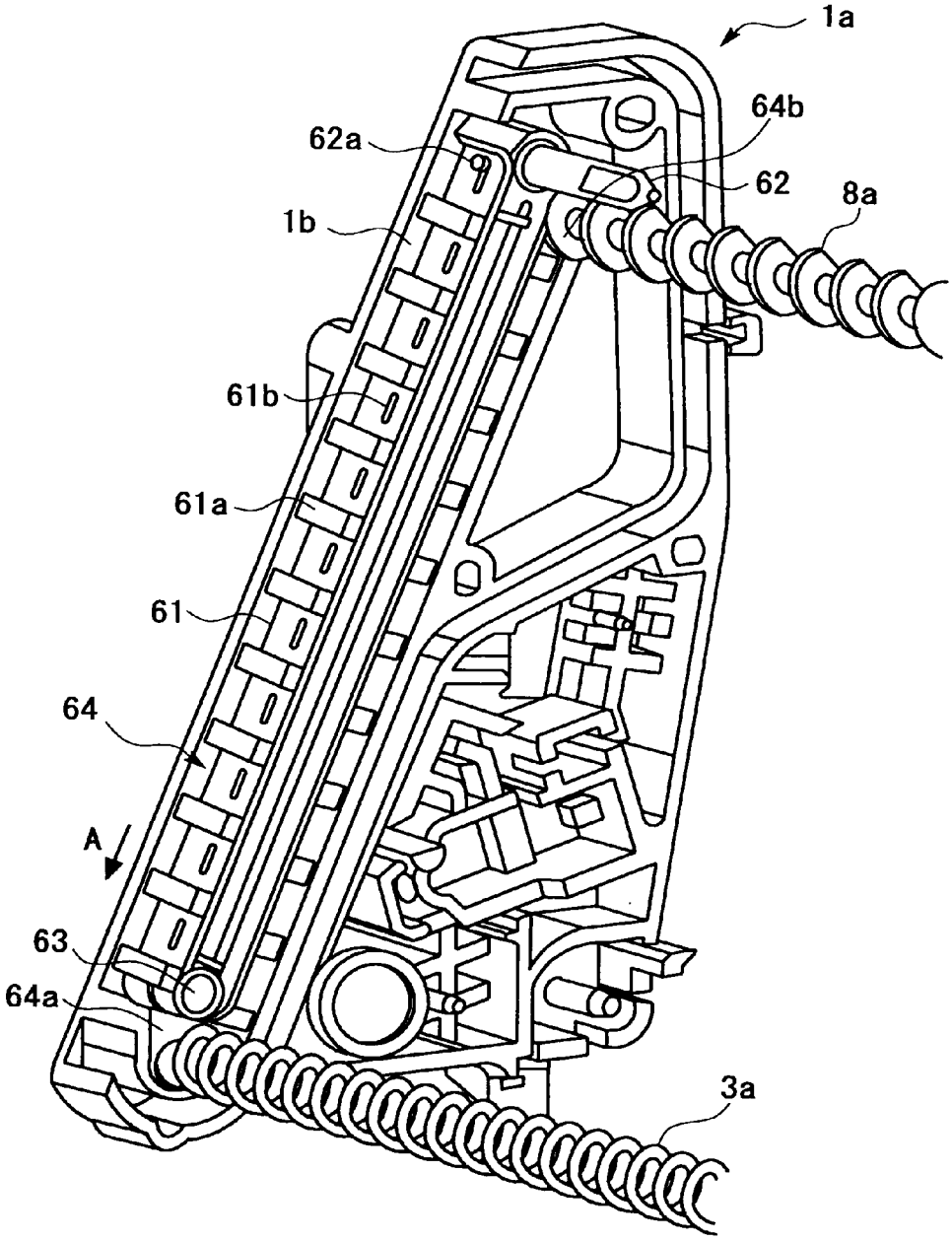
FIG. 3 is a schematic structural view illustrating a toner recovery apparatus of the same printer.

FIG. 2 is a schematic structural view illustrating a process unit of the printer. FIG. 3 is a schematic structural view illustrating the toner recovery apparatus. An endless groove 1*b* is formed on the process cartridge side surface 1*a*, and this groove 1*b* is covered with a cover member (not shown), thereby a toner transporting duct 64 is formed that has a square cross section. This toner transporting duct 64 obliquely runs toward the upper part from the lower part. The lower part of the front side surface of the toner transporting duct 64 is provided with an opening inlet 64*a* to which a toner transporting screw 3*a* of a drum cleaning device 3 is connected. An opening outlet 64*b* is also provided in the upper part of the front side surface of the toner transporting duct 64 so as to face the belt provided below, and this outlet 64*b* is connected to a toner recovery route 8 equipped with a toner recovery screw 8*a* therein. An endless toner transporting belt 61 is disposed in the toner transporting duct 64, and the toner transporting belt 61 is bridged with tension to a driven roller 63 and a driving roller 62. The driven roller 63 and the driving roller 62 are rotatably supported by the toner transporting duct in the side surface of the process cartridge. The driving roller 62 is connected to a driving means (not shown) and is driven to rotate. Further, the driving roller is provided with pins 62*a* that are projected portions extending from the driving roller 62.

Figure 4:
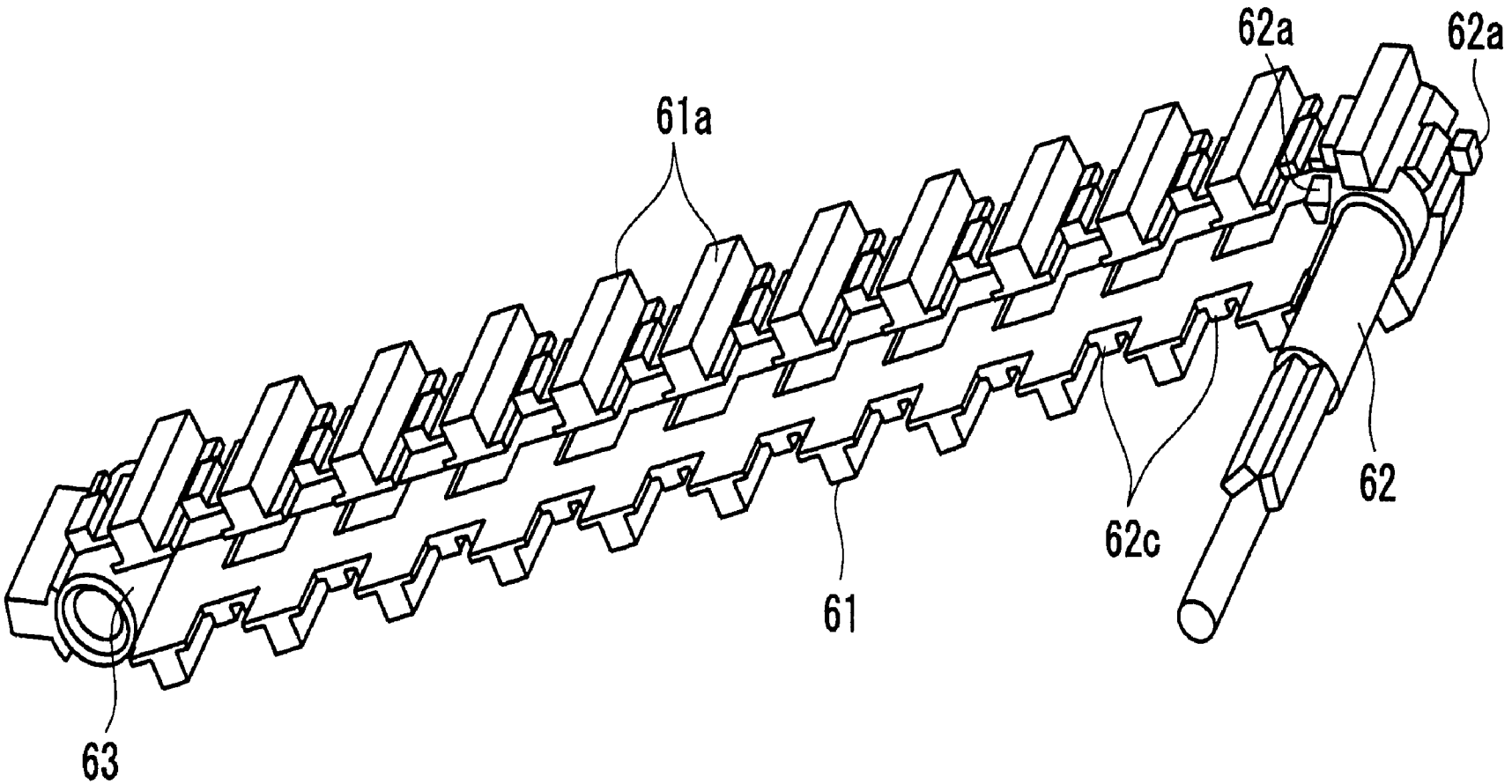
FIG. 4 is a view illustrating another structure of the toner transporting belt.

FIG. 4 is a view showing another structure of the toner transporting belt. The convex parts 61*a* are formed on the outer circumferential surface of the toner transporting belt 61. Further, long pores 61*b* extending in the belt moving direction are formed between the convex parts at intervals conforming to the pitch of the pins 62*a* on the rotating driving roller 62. The pins 62*a* to be projected portions extending from the driving roller 62 penetrate through and engage with long pores 61*b* at the part of winding up around the driving roller 62. When the driving roller 62 in the toner transporting belt 61 rotates, the pins 62*a* engage with the long pores, rotational driving force is transmitted to the toner transporting belt 61 via the pins 62*a*, and the toner transporting belt 61 is rotationally driven in the A direction shown in the figure.

When the toner transporting belt 61 is made of rubber, even though a dimensional relationship between the pin 62*a* and the long pore 61*b* is rough, the long pore 61*b* is deformed, and the pin 62*a* can engage with the long pore 61*b*, penetrating through the long pore 61*b*. However, when the toner transporting belt 61 is made of thermoplastic elastomer, if the dimensional relationship between the pin 62*a* and the long pore 61*b* is rough, the pin 62*a* cannot penetrate through the long pore 61*b*. Therefore, when the toner transporting belt 61 is made of material that is hardly changed compared with a rubber, such as a thermoplastic elastomer, a notched part 61*c* is provided on both ends in the belt width direction between the projected portions. The pin 62*a* of the driving roller 62 is alternately stood at the notched part 61*c* on the both ends. According to this, the belt 61 and the driving roller 62 are engaged, and rotational driving force of the driving roller 62 is transmitted to the toner transporting belt 61 to rotationally drive the toner transporting belt 61.

The convex part 61*a* of the toner transporting belt 61 has the same width as the belt, and its top surface has a height that allows it be in contact with the belt facing surface of the toner transporting duct 64 without any gap. The convex part 61*a* also has an enough thickness to avoid a sag due to a frictional force with the toner transporting duct 64 or a weight of residual toner. In the present embodiment, the residual toner is transported to the outlet 64*b* by holding the toner with the bottom surface of the toner transporting duct 64 and the convex part 61*a*, by rotating the toner transporting belt 61. Therefore, if the convex part 61*a* sags by a frictional force with the toner transporting duct 64 or a weight of the residual toner, the residual toner is gathered at the top portion of the convex part 61*a* more, and thus the weight of the residual toner is concentrated at the top portion of the convex part 61*a*. As a result, sagging in the convex part is progressed, a gap is generated between the top portion of the convex part 61*a* and the bottom surface of the toner transporting duct 64, thus, the residual toner falls down, and there is a possibility of lowering a transportation amount of the residual toner. Therefore, in the present embodiment, the convex part 61*a* is formed to have an enough thickness not to sag by a weight of a residual toner or a frictional force with the toner transporting duct 64 so that generation of a gap between the top portion of the convex part 61*a* and the internal wall of the toner transporting duct 64 is prevented.

Figure 5:
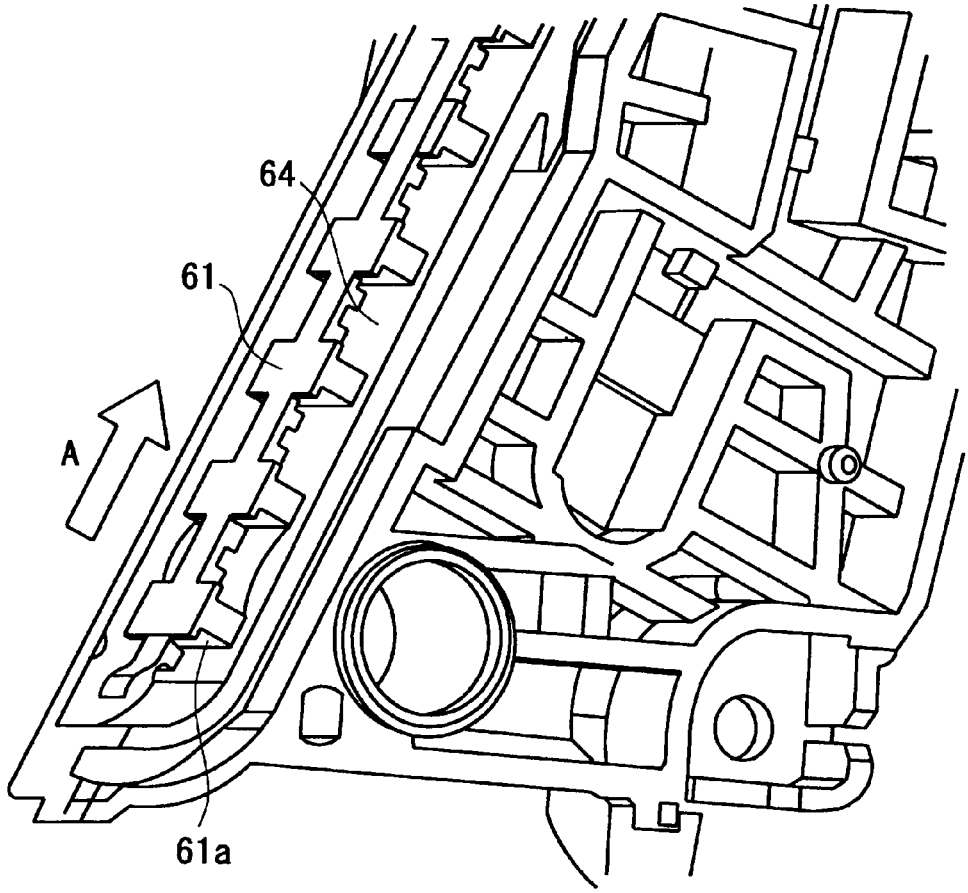
FIG. 5 is a view illustrating a condition of transporting a residual toner after a transferring step.

FIG. 5 is a view illustrating a condition of transporting a residual toner. The residual toner removed by a drum cleaning device 3 is transported to the inlet 64 in a lower part of the toner transporting duct 64 by a toner transporting screw 3*a*. The residual toner transported in a lower part of the toner transporting duct 64 is scraped out by the convex part 61*a* of the toner transporting belt 61. The residual toner scraped out by the convex part 61*a* is transported upward, by being held with the convex part 61*a* and the bottom surface of the toner transporting duct 64. When the residual toner is transported to the outlet 64*b* provided in an upper part of the toner transporting duct 64 by the toner transporting belt 61, the residual toner falls down to a toner recovery route 8 from a discharge part 64*b*. The residual toner fell down to the toner recovery route 8 is transported to a toner recovery part 7 to be collected by a toner recovery screw 8*a*.

As for a toner used in the toner recovery apparatus of the present invention, a toner base particle contains at least a binder resin and a coloring agent.

As a binder resin of the toner base particle, resins known in fields of electrophotography and electrostatic printing can be used, and suitable examples include styrene resins; acrylic resins such as alkyl acrylate and alkyl methacrylate; styrene acrylic copolymer resins; polyester resins; silicone resins; olefin resins; amide resins; and epoxy resins.

Particularly, when used in a full color toner for oil-less fixing, it is preferable that an elastomer resin component (first binder resin) and a sharp melt low molecular weight resin component (second binder resin) are used in combination, from the viewpoint of fixation separating property and preferable image glossiness. Kinds of the first binder resin and the second binder resin are not particularly limited, and binder resins known in the field of full color toners, for example, polyester resins, (meth)acrylic resins, styrene-(meth)acrylic copolymer resins, epoxy resins, COC (cyclic olefin resins such as TOPAS-COC, manufactured by Ticona Co.) may be used, but it is preferable to use a polyester resin for both of the first binder resin and the second binder resin from the viewpoint of oil-less fixing.

As polyester resins preferably used in the present invention, polyester resins obtained by polycondensation of polyvalent alcohol components and polyvalent carboxylic acid components can be used. Examples of bivalent alcohol components among polyvalent alcohol components include bisphenol A alkylene oxide adducts such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, and polyoxyethylene(2,0)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butanediol, 1,5-pentanediol, 1,6-hexanediol, 1,4-cyclohexane dimethanol, dipropylene glycol, polyethylene glycol, polytetramethylene glycol, bisphenol A, hydrogenated bisphenol A, and the like. Examples of a trivalent or higher valent alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

Examples of bivalent carboxylic acid components among polyvalent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and anhydrides or lower alkyl esters of these acids.

Examples of trivalent or higher valent carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, EnPol trimer acid, and anhydrides and lower alkyl esters of these acids, and the like.

Additional polyester resins that can be suitably used in the present invention are those prepared by conducting condensation polymerization (to obtain polyester resin) and radical polymerization (to obtain vinyl resin) in parallel with respect to a mixture of a source monomer for a polyester resin, a source monomer for a vinyl resin, and a monomer reacting with both of the source monomers in a vessel at a time (hereinafter simply referred to as "vinyl polyester resin"). Herein, the monomer reacting with both of the source monomers of resins is, in other word, a monomer which can be used in both of the condensation polymerization reaction and radical polymerization reaction. That is, the monomer has a carboxy group capable of condensation polymerization reaction, and has a vinyl group capable of reacting in the radical polymerization reaction, and examples thereof include fumaric acid, maleic acid, acrylic acid, and methacrylic acid.

Examples of the source monomer of the polyester resin include the above described polyvalent alcohol components and polyvalent carboxylic acid components. Examples of the source polymer for a vinyl resin component include styrene or styrene derivatives such as styrene, o-methylstyrene, m-methylstyrene, p-methylstyrene, α-methylstyrene, p-ethylstyrene, 2,4-dimethylstyrene, p-tert-butylstyrene, and p-chlorstyrene; ethylenic unsaturated monoolefine such as ethylene, propylene, butylene, and isobutylene; methacrylate alkyl esters such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl methacrylate, hexyl methacrylate, octyl methacrylate, nonyl methacrylate, decyl methacrylate, undecyl methacrylate, and dodecyl methacrylate; acrylate alkyl esters such as methyl acrylate, n-propyl acrylate, isopropyl acrylate, n-butyl acrylate, isobutyl acrylate, t-butyl acrylate, n-pentyl acrylate, isopentyl acrylate, neopentyl methacrylate, 3-(methyl)butyl acrylate, hexyl acrylate, octyl acrylate, nonyl acrylate, decyl acrylate, undecyl acrylate, and dodecyl acrylate; unsaturated carboxylic acids such as acrylic, acid, methacrylic acid, itaconic acid, and maleic acid; acrylonitrile, maleic acid ester, itaconic acid ester, vinyl chloride, vinyl acetate, vinyl benzoate, vinyl methyl ethyl ketone, vinyl hexyl ketone, vinyl methyl ether, vinyl ethyl ether, and vinyl isobutyl ether. Examples of a polymerization initiator at the time of polymerizing a source monomer of a vinyl resin include azo- or diazo polymerization initiators such as 2,2'-azobis(2,4-dimethylvaleronitrile), 2,2'-azobisisobutyronitrile, 1,1'-azobis (cyclohexene-1-carbonitrile), and 2,2'-azobis-4-methoxy-2, 4-dimethylvaleronitrile, and peroxide polymerization initiators such as benzoyl peroxide, dicumyl peroxide, methyl ethyl ketone peroxide, isopropyl peroxycarbonate, and lauroyl peroxide.

As the first binder resin and second binder resin, various polyester resins as described above are preferably used, but among those, from the viewpoints of further improving separating property and offset resistance as an oil-less: fixing toner, it is preferable to use the first binder resin and the second binder resin which are shown in the following.

A preferable first binder resin is a polyester resin obtained by polycondensation of the above described polyvalent alcohol component and polyvalent carboxylic acid component, particularly, a polyester resin obtained by using a bisphenol A alkylene oxide adduct as the polyvalent alcohol component and using terephthalic acid and fumaric acid as the polyvalent carboxylic acid component.

As a preferable second binder resin is a vinyl polyester resin, particularly, a vinyl polyester resin obtained by using a bisphenol A alkylene oxide adduct, terephthalic acid, trimellitic acid, and succinic acid as a source monomer of a polyester resin, using styrene and butyl acrylate as a source monomer of a vinyl resin, and using fumaric acid as a monomer reactive to both of the reactions.

In the present invention, in order to further increase a wax necessary for oil-less color fixation, it is preferable to add a wax into the above described binder resin in advance. In this case, the wax may be added into any of the first binder and the second binder; however, from the viewpoint of easily loading shear at the time of kneading in a pulverization method, it is preferable to add the wax into the first binder. For adding the wax into the first binder resin in advance, when the first binder resin is synthesized, synthesis of the first binder resin may be preformed in the state of adding the wax in a monomer for synthesizing the first binder resin. For example, a polycondensation reaction may be performed in the state of adding a hydrocarbon wax to an acid monomer and an alcohol monomer constituting a polyester resin as the first binder. In the case that the first binder resin is a vinyl polyester resin, in the state of adding a hydrocarbon wax to a source monomer of a polyester resin, while the monomer is stirred and heated, thereto was added dropwise a source monomer of a vinyl resin, thereby a condensation polymerization reaction and a radical polymerization reaction may be performed.

The content of the first binder resin (including internally added wax) to the second binder resin in toner particles is 20/80 to 45/55 by weight, and preferably 30/70 to 40/60. If an amount of the first binder resin is too small, separating property and high temperature offset resistance are lowered to cause a problem. When the amount of the first binder resin is too large, glossiness and heat resistant storageability are lowered.

A binder resin composed of the first binder resin and the second binder resin used at the above described weight ratio preferably has a softening point of 100° C. to 125° C., and particularly 105° C. to 125° C.

Examples of a releasing agent (wax) which can be used in the present invention include a polyethylene wax, polypropylene wax, carnauba wax, rice wax, sasol wax, montan ester wax, Fischer-Tropsch wax, and paraffin wax. When such a wax is used in a full color toner for oil-less fixation, a wax having a melting point of 60° C. to 100° C., preferably 65° C. to 90° C. can be preferably used, and examples thereof include aliphatic acid ester, low molecular weight polyethylene, carnauba wax, and low melting point paraffin. A particularly preferable wax is low melting point paraffin having low polarity and high releasing effect. It is necessary to use a releasing agent as an essential component particularly in an oil-less fixing color toner. When a softening point of a wax is lower than 60° C., an effect of improving high temperature offset property is lowered, and when higher than 100° C., dispersion into a binder resin is insufficient, and thus filming to a photoconductor is likely to be generated. An amount adding to a toner, in the case of adding to a toner in a pulverization method, is contained within the range from 3.0 to 10 wt %, and preferably within the range from 3.5 to 8 wt %. When less than this ranges, the releasing effect is not exhibited, and when more than this range, due to wax dispersion defect in melt kneading, free wax is likely to be generated to easily cause a problem of filming, which is thus not preferable.

On the other hand, in a toner obtained in a wet granulation method, disposal control of a wax into the toner, such as capsulation, is comparatively easy, since the toner in a wet granulation method has latitude against wax dispersion defect and free wax generation contrast to a pulverization method toner, an addition amount of the wax can be increased to 5 to 12% by weight.

As a coloring agent used in the present invention, known pigments and dyes can be used, and it is not particularly limited. Examples of a coloring agent include carbon black, aniline blue, charcoal blue, chrome yellow, ultramarine blue, dupont oil red, quinoline yellow, methylene blue chloride, copper phthalocyanine, malachite green oxalate, lamp black, rose bengal, C. I. Pigment-Red 48:1, C. I. Pigment-Red 122, C. I. Pigment-Red 57:1, C. I. Pigment-Red 184, C. I. Pigment-Red 269, C. I. Pigment-Red 150, C. I. Pigment-Red 146, C. I. Pigment-Yellow 97, C. I. Pigment-Yellow 12, C. I. Pigment-Yellow 17, C. I, Solvent-Yellow 162, C. I. Pigment-Yellow 180, C. I. Pigment-Yellow 93, C. I. Pigment-Yellow 185, C. I. Pigment-Yellow 74, C. I. Pigment-Yellow 155, C. I. Pigment-Blue 15:1, and C. I. Pigment-Blue 15:3. When a coloring agent is used in a color toner, it is preferable that the coloring agent is subjected to a master batch treatment or a flushing treatment, so that the coloring agent is highly dispersed in a binding resin in advance to be used. The content of the coloring agent is preferably 2 to 15 parts by mass per 100 parts by mass of the binding resin.

It is possible to add additives such as a charge controlling agent to the toner base particles, according to need. As a charge controlling agent for negatively charged toner, examples include chromium complex salt azo dye S-32, 33, 34, 35, 37, 38, and 40 (manufactured by Orient Chemical Industries, Ltd.), Aizen Spilon black TRH and BHH, (manufactured by HODOGAYA CHEMICAL CO., LTD.), Kayaset Black T-22 and 004, (manufactured by NIPPON KAYAKU CO., LTD.), copper phthalocyanine dye S-39 (manufactured by Orient Chemical Industries, Ltd.), chromium complex salt E-81 and 82 (manufactured by Orient Chemical Industries, Ltd.), zinc complex salt E-84 (manufactured by Orient Chemical Industries, Ltd.), aluminum complex salt E-86 (manufactured by Orient Chemical Industries, Ltd.), boron complex salt LR-147 made from benzilic acid derivatives (manufactured by Japan Carlit Co., Ltd.), and a calixarene compound. Further as a negative charge controlling agent used in a full color toner, a colorless, white or pale colored charge controlling agent, which does not adversely affect on color tone and light transmittance of a color toner, can be used, and examples such as metal complex of zinc or chromium of salicylic acid derivatives, a calixarene compound, organic boron compound made by benzilic acid derivatives, fluorine-containing quaternary ammonium salt compound can be preferably used. As the above described salicylic acid metal complex, examples described in JP-A Nos. 53-127726, 62-145255 etc., can be used. As the calixarene compound, examples described in JP-A No. 02-201378 can be used. As the organic boron compound, examples described in JP-A No. 02-221967 can be used. As the organic boron compound, examples described in JP-A No. 03-1162 can be used.

Any known method can be used as a method for producing toner base particles, and examples include a dry pulverization method, a wet emulsification method, suspension polymerization, dissolution polymerization (emulsifying granulation), and the like. Generally, in the case of a pulverization method, amorphous particles can be obtained, and in the case of a wet method, spherical particles can be obtained. A toner production method suitable for an image forming process may be used. From the viewpoint of image quality, a toner base particle preferably has a small particle diameter, and a particle having a volume average particle diameter of approximately 4 to 10 μm can be preferably used. In particular, it is preferable to use a toner base particle having a volume average particle diameter of 5 to 10 μm in the present invention.

As an external additive, known materials, for example, commercially available toner silica, alumina, and titanium can be used alone or in combination. It is preferable to use such an external additive which has been subjected to hydrophobizing treatment for enhanced environmental stability, and as a hydrophobizing agent, various coupling agents such as silane, titanate, aluminum, and zircoaluminate, and a silicone oil, and the like can be used. Particularly, as the above-described external additive, from the viewpoints of flowability and transferring property of a toner, and environmental stability to electrostatic charge, various specific surface areas and a grade of a hydrophobizing surface-treating agent are selected, and can be suitably used in combination.

As the hydrophobizing agent, examples include a silane coupling agent, a titanate coupling agent, a silicon oil, a silicon varnish, and the like can be used. Examples of the silane coupling agent such as hexamethyldisilazane, trimethylsilane, trimethylchlorsilane, dimethyldichlorsilane, methyltrichlorsilane, allyldimethylchlorsilane, benzyldimethylchlorsilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane can be used. Examples of a silicone oil such as dimethylpolysiloxane, methyl hydrogen polysiloxane, and methylphenyl polysiloxane.

A surface treatment of a base material of silica or titanium by the above described hydrophobizing agent can be preformed by, for example, a dry method in which the hydrophobizing agent is diluted with a solvent, the diluted solution is added to the base material to be mixed, and the mixture is heated and dried, and then pulverized, or a wet method in which a base material is dispersed in an aqueous system to be a slurry, then thereto is added a hydrophobizing agent to be mixed, and the mixture is heated and dried, and then pulverized.

When a toner is produced by a pulverization method, the toner is manufactured in accordance with a conventionally known method. And a toner production method can be employed that includes a step of mechanically mixing toner components including a resin and a wax (including those internally added in resin), and a coloring material, a step of melt-kneading, a step of pulverizing, and a step of separating in grades can be applied. Further, also included is a method in which, in the step of mechanical mixing and the step of melt-kneading, powder other than particles to be a product obtained in the step of pulverizing and classifying is placed back and reused.

When a toner is produced in an emulsion polymerization method, at least a wax is dissolved or dispersed in a vinyl monomer, and the wax is added into the vinyl resin dispersion by a method such as miniemulsion polymerization, the vinyl resin dispersion into which the wax is added, a pigment dispersion and the like are combined together, and fused to obtain a toner slurry, and then, the toner slurry is recovered by washing and filtration according to a known method, and then dried, thereby a toner can be isolated.

As a toner production method in which an oil drop of an organic solvent dissolved with a toner composition containing a polymer is dispersed in an aqueous medium, and granulated to obtain a toner, in recent years, there is a dissolution suspension extension method where molecular weight control and structure controlling property of a toner are further enhanced. This production method is a method in which an oil drop of an organic solvent dissolved with a toner composition containing a prepolymer is dispersed in an aqueous medium, and thereby particles formed by an extension reaction and/or a crosslinking reaction are obtained.

According to this method, a polyester resin that has been impossible to be used in an emulsion polymerization method and a suspension polymerization method can be used, and a full color toner excellent particularly in fixing property can be produced. In addition, due to an extension reaction of a prepolymer by an urethane/urea bonding, molecular weight control of a polymer side is easily conducted, and thus it is suitable for production of a full color toner for oil-less fixing.

As a method for an external addition treatment of an inorganic particle in the present invention to the toner base particle obtained as described above, a method of mixing in a dry process by a mixer such as a Henschel mixer is preferable. After the treatment, it is preferable to further pass through a sieve with 100 μm or less mesh from the viewpoint of removal of contaminates.

Figure 6:
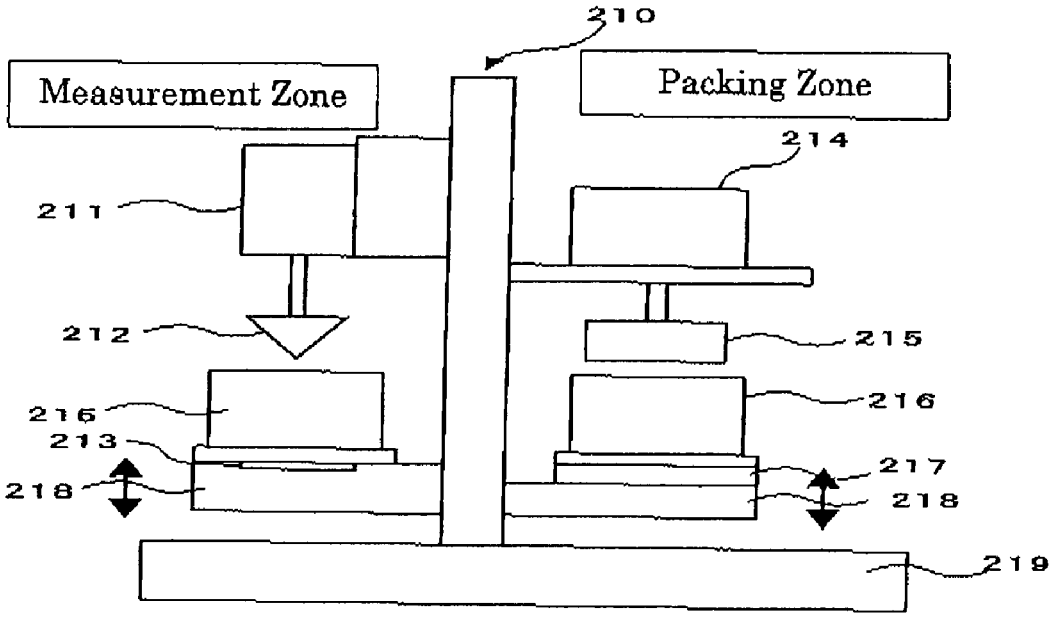
FIG. 6 shows an example of an evaluation device used in the present invention.

FIG. 6 shows an example of an evaluation device used in the present invention. The evaluation device is composed of a packing zone and a measurement zone.

The packing zone is composed of a container 216 containing a powder, a lifting stage 218 lifting the container up and down, a piston 215 for consolidating the powder, and a weight 214 adding a load to the piston.

In this structural example, the sample container 216 containing a powder is lifted up to be brought into contact with the piston 215 for packing, then is further lifted up to be in a state where the weight 214 is floated higher than a supporting plate 219 so that the whole weight of the weight 214 is applied on the piston 215, which is left stand for a predetermined time. Thereafter, the lifting stage 218 on which the container 216 containing a powder is descended and the piston 215 is released from the powder surface.

The piston 215 may be made of any material, but it is necessary to have a smooth surface against which a powder is pressed. Therefore, it is preferable to use a material that is easily processed, has a solid surface, and does not deteriorates. It is further necessary to avoid unwanted attachment of powder to the piston 215 due to electrostatic charge, and thus, a conductive material is suitable. Examples of this material include SUS, Al, Cu, Au, Ag, and brass.

In the present invention, the container 216 containing a powder was set to have an inner diameter of 60 mm, and a height of a powder after completion of packing of 25 to 28 mm.

The measurement zone is, as shown in FIG. 6, composed of a container 216 containing a powder, a lifting stage 218 lifting up and down the container, a load cell 213 measuring a weight, which is provided on the stage, and a torque meter 211 measuring a powder torque. This structure is for illustrative purpose only, and does not intend to limit the present invention in any way.

A conical rotor 212 is attached to an edge of a shaft, and the shaft itself is fixed so as not to move in upper and lower directions.

The sample container stage containing a powder can be lifted up and down by a lifting machine, the container 216 containing a powder is placed on the center of the stage, and by lifting up the container, the conical rotor 212 intrudes into the center of the container with rotating.

A torque applied on the conical rotor 212 is detected by the torque meter 211 on the upper part, a weight loaded on the container 216 containing a powder is detected by the load cell 213 disposed under the container, and the amount of movement of the conical rotor 212 is detected by a position detector.

This structure is a one example, and other structure such that the shaft itself can be lifted up and down by a lifting machine can be also applied.

Figure 7:
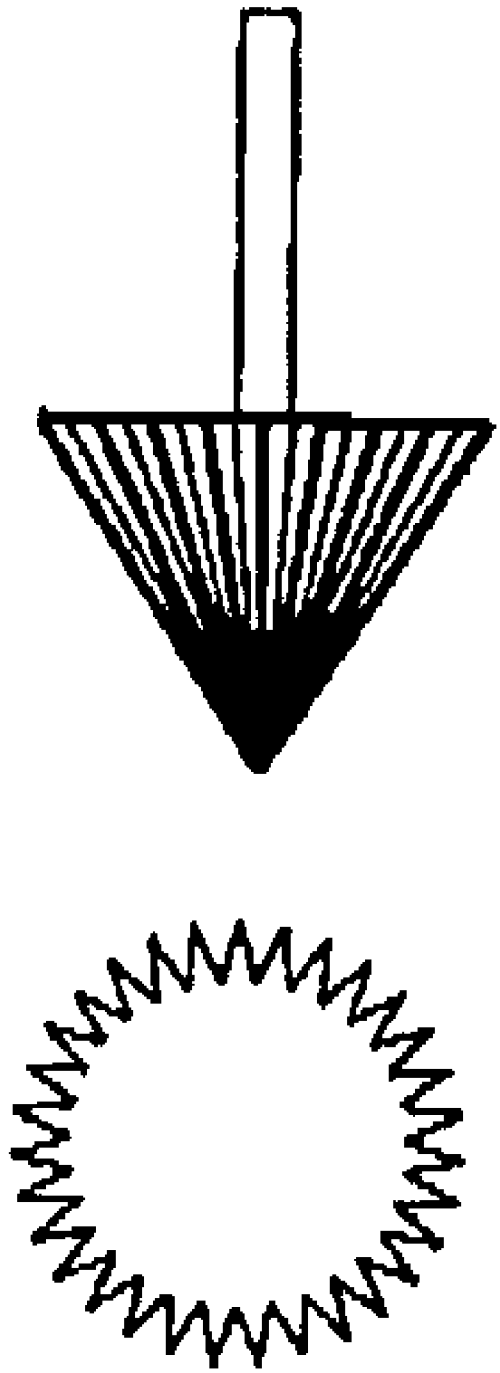
FIG. 7 is a view illustrating a conical rotor forming grooves on the surface.

FIG. 7 is a view illustrating a conical rotor having grooves formed on the surface. The shape of the conical rotor 212 has an apex angle of a cone of 60 degrees, and grooves are cut as shown in FIG. 7. The grooves are cut straight down to the direction of a base line from the apex of the cone, and a sectional view of the grooves is a saw-teeth shape made by triangular irregularity. The conical rotor has a length of 30 mm on a side, a groove depth of the apex of 0 mm, and a groove depth of the bottom surface of 1 mm, and the grooves gradually become deeper. The number of the grooves is 48.

The friction component between the material surface of the conical rotor 212 and a toner particle is not measured, but the friction component between a toner particle and a toner particle is measured.

The material surface of the conical rotor 212 and the toner particles is in contact only at top edges of triangular grooves. Most of the toner particles which are loaded into the grooves are in contact with nearby toner particles.

The material of the conical rotor 212 is not particularly limited, and a material which is easily processed, has a solid surface, and does not deteriorate is preferable, and further, a material which does not take on electrostatic charge is suitable. Specific examples include SUS, Al, Cu, Au, Ag, and brass.

Flowability of a toner powder of a toner is evaluated by measuring a torque or a weight generated when a conical rotor is intruded into a powder phase with rotating, and the conical rotor moves in the powder phase. Specifically, the conical rotor is intruded into (descend) or retrieved from (up) the toner powder phase with rotating, and at this time, a torque and a weight which are loaded on the conical rotor and a container containing the conical rotor and the toner powder phase are measured, thereby, flowability is evaluated according to values of the torque and the weight. The torque and the weight of the toner powder vary depending on the rotational speed of the conical rotor, in other word, a rotation speed per every minute (hereinafter abbreviated by rotation speed, and a unit is rpm), and an intrusion rate of the conical rotor. Thus, in order to increase measurement accuracy, a measurement is conducted by decreasing a rotation speed and an intrusion rate of the conical rotor 10 so that a slight contact state among toner particles can be measured. Therefore, the measurement conditions are set as follows:

Rotation speed of the conical rotor: 0.1 to 100 rpm

Intrusion rate of the conical rotor: 0-5 to 150 mm/min

In the present invention, the measurement was conducted under the following conditions:

Rotation speed of the conical rotor: 1.0 rpm

Intrusion rate of the conical rotor: 1.0 mm/min

Application of pressure on a toner layer: pressurized at 0.1 $kg/cm^2$ or more for 60 seconds or more Shape of the conical rotor: an angle of the cone from the rotational axis (center axis) of the cone of 30 degrees, a shape in which grooves (¼ depth of radius) with N=48 are notched. In addition, the number of the grooves takes the same value when N is 20 or more.

A space ratio of the toner powder layer is also important. The space ratio is found according to the following formula:

$$\epsilon=(V-M/\rho)/V$$

wherein $\epsilon$ denotes a space ratio, M denotes a mass of the toner powder filled in a measuring container, $\rho$ denotes an absolute specific gravity of the toner powder, and V denotes a volume of the toner layer.

Generally, a toner is not made only of toner particles, but is suitably mixed with inorganic or organic additives such as silica and titanium oxide for use. Not only adjusting properties of the above described toner base, adjusting properties of the toner after mixing additives allows cleaning property to be more stabilized. An additive such as silica is generally used for improvement in flowability of a toner. The improvement in flowability namely means lowering of a frictional coefficient among toner particles, which results in a reduced torque by a conical rotor used in the present invention.

A higher space ratio is better. As a result of studies, when the space ratio is 50% or more, preferable cleaning property is likely to be obtained. The relationship between a space ratio and cleaning property has not been revealed, but as the space ratio is lower, the density of a toner accumulated at an edge of a cleaning blade becomes higher; thus, it is considered that the toner tends to easily slip through, pushing up the cleaning blade. When the space ratio exceeds 60%, the toner tends to easily float, and thus an inside of an image forming apparatus may be stained because of toner splash, and the like.

In the present invention, if a toner has a space ratio of 50% to 60% in a toner recovery apparatus, and at the point of time when a conical rotor intrudes at 20 mm, a rotational torque is within the range from 1.0 mNm to 2.5 mNm in the above described torque measurement method, favorable cleaning property is exhibited. The reason for that is not clear, but it can be considered that in a state of operation of the cleaning blade, the toner is retained around a contact part of the blade and a photoconductor, and at the time of being brought into contact with a toner newly transported on a photoconductor, if a frictional coefficient between toner particles is strong, the toner is likely to be peeled off from the photoconductor. When a rotational torque is less than 1.0 mNm, the toner tends to easily float due to small toner coagulation force, and thus, the inside of the image forming apparatus may be stained. When the rotational torque is more than 2.5 mNm, toner coagulation force becomes large, and cleaning is hardly performed, which may result in occurrence of a defect image such that a previous image is remained.

T1/2 of a toner used in the toner recovery apparatus of the present invention and a temperature at the completion of outflow are values measured by a flow tester CFT-500D manufactured by Shimadzu Corporation, and the measurement was conducted by setting an outlet diameter of 0.5 mm, a depth of 1 mm, and a temperature increase of 3° C./min. A weight applied on a test sample was set at 20 kgf.

As a differential scanning calorimeter (DSC), DSC6200 manufactured by Seiko Instruments Inc. was used. A sample in which a temperature was increased to 200° C., and from the temperature, then cooled to 0° C. at a temperature decrease rate of 10° C./min was measured at a temperature increase rate of 10° C./min. According to this analysis, glass transition temperatures of a resin and a toner, and a melting point of a wax are calculated.

A measurement of a toner particle diameter is conducted by the Coulter counter method. Examples of measuring devices for a particle diameter distribution of toner particles by the Coulter counter method include Coulter counter TA-II, Coulter multisizer II, and Coulter multisizer III (all of these are manufactured by Beckman Coulter, Inc.) The measurement method will be described in the following.

First, to 100 ml to 160 ml of an aqueous electrolysis solution, 0.1 ml to 5 ml of a surfactant (preferably, alkyl benzene sulfonate) is added as a dispersant. Herein, the electrolysis solution means an approximately 1% NaCl aqueous solution prepared by using primary sodium chloride, and for example, ISOTON-II (manufactured by Beckman Coulter, Inc.) can be used. Herein measurement sample in an amount of 2 mg to 20 mg is further added thereto as a solid content. The electrolysis solution suspended with the test sample is subjected to a dispersion treatment by an ultrasonic dispersion unit for about 1 to 3 minutes, and by the ultrasonic dispersion unit, using a 100 μm aperture as an aperture, a volume of toner particles or a toner, and the number thereof are measured, and a volume distribution and a number distribution are calculated. A weight average particle diameter (Dv) and a number average particle diameter (Dn) can be found from the obtained distributions.

As a measurement method of a toner shape, a technique of an optical detection zone in which a suspension containing particles are passed through an imaging detection zone on a flat plate to optically detect and analyze a particle image by a CCD camera is suitable. It was proved that an average circularity that is a value obtained by dividing a round length of a correspondent circle equal to a project area obtained in this method by a round length of existing particles of 0.89 or more is effective to form a highly fine image having reproducibility with an appropriate concentration. More specifically, the average circularity is 0.89 to 0.97. This value is calculated as the average circularity by a flow type particle image analyzer FPIA-2000. As a specific measurement method, to 100 ml to 150 ml of water from which an impurity solid substance in a container is removed in advance 0.1 ml to 0.5 ml of a surfactant, preferably, alkyl benzene sulfonate is added as a dispersant, and thereto is further added approximately 0.1 g to 0.5 g of a test sample. A suspension dispersed with the sample is subjected to a dispersion treatment by an ultrasonic dispersion unit for about 1 to 3 minutes, and adjusting a concentration of the dispersion to 3,000 to 10,000 particles/μl, the average circularity can be obtained by measuring a shape and a distribution of the toner by the above device.

EXAMPLES

The present invention will be then further specifically explained in detail with reference to Examples. However, the present invention is not limited to the following Examples. In addition, all of parts indicate parts by mass in Examples.

(Preparation of Toner Particles in Pulverization Method)

| <Production of Resin H1> | |
|---|---|
| As a vinyl monomer, | |
| styrene | 600 g, |
| butyl acrylate | 110 g, |
| acrylic acid | 30 g, and |
| dicumyl peroxide as a polymerization initiator | 30 g |
| were charged in a dropping funnel. | |
| Among monomers of polyester, | |
| polyoxypropylene(2.2)-2,2-bis(4-hydroxyphenyl)propane (as polyol) | 1,230 g, |
| polyoxyethylene(2.2)-2,2-bis(4-hydroxyphenyl)propane (as polyol) | 290 g, |
| isododecenyl succinic anhydride | 250 g, |
| terephthalic acid | 310 g |
| 1,2,4-benzenetricarboxylic anhydride | 180 g, and |
| dibutyl tin oxide (as esterification catalyst) | 7 g |

were charged in a 5 ml four-neck flask equipped with a thermometer, a stainless stirring device, an flow type condenser and an nitrogen induction tube, while stirring in a mantle heater at a temperature of 160° C. under a nitrogen atmosphere, a mixture of a vinyl monomer resin and a polymerization initiator was added dropwise by a dropping funnel taking over 1 hour. An addition polymerization reaction was aged for 2 hours with keeping 160° C., and then the temperature was increased to 230° C. to perform a condensation polymerization reaction. In terms of a polymerization degree, tracking was performed from a softening point measured using a capillary constant load extrusion rheometer, and the reaction was terminated at the time of reaching a desired softening point to obtain a resin H1. The softening point (T1/2) of the resin H1 thus obtained was 130° C.

<Production of Resin L1>

With respect to resin L1, the following monomers were charged to synthesize a polyester resin in the same process for producing resin H1 except that no vinyl monomer was added.

| | |
|---|---|
| Polyoxypropylene(2,2)-2,2-bis(4-hydroxyphenyl)propane | 1,650 g, |
| Polyoxyethylene(2,2)-2,2-bis(4-hydroxyphenyl)propane | 660 g |
| Isododecenyl succinic anhydride | 190 g |
| Terephthalic acid | 750 g |
| 1,2,4-benzenetricarboxylic anhydride | 190 g |
| Dibutyl tin oxide as an esterification catalyst | 0.3 g |

The softening point (T1/2) of resin L1 thus obtained was 113° C.

| <Production of Toner Base Particles (Pulverization method)> | |
|---|---|
| Resin H1 | 30 parts |
| Resin L1 | 70 parts |
| Paraffin wax, (melting point = 73.3° C.) | 5 parts |
| Coloring agent (copper phthalocyanine blue pigment) | 2.5 parts |

The above materials were sufficiently mixed by a blender, and then the mixture was kneaded by a pressure kneader, and after cooling, coarsely pulverized by a feather mill. The coarsely pulverized material was further kneaded by an open roll mill, then pulverized after cooling, separated in grades to obtain a cyan color toner base (a) having a volume average particle diameter of approximately 8.0 μm. The softening point T1/2 of the toner (a) was 120° C., and a circularity was 0.922. In the production example of the toner (a), an addition amount of a paraffin wax was increased to 12 parts, and the other conditions were all the same as the toner (a), and a cyan color toner base (b) was obtained. An average particle diameter of the toner (b) was 8.5 μm, a softening point T1/2 was 121° C., and a circularity was 0.918.

(Preparation of Toner Particles in Emulsion Polymerization Method)

| <Cyan Coloring Agent Dispersion> | |
|---|---|
| Pigment C.I. pigment blue 15 | 350 parts by mass |
| Sodium dodecyl sulfate | 10 parts by mass |
| Ion exchange water | 200 parts by mass |

The above materials were dispersed by a sand grinder mill, and a cyan coloring agent dispersion having a volume average particle diameter (D50) of 170 nm was obtained

| <Preparation of Latex> Preparation of Latex 1L (Dispersion medium) | |
|---|---|
| Sodium dodecyl sulfate | 4.05 g |
| Ion exchange water | 2,500 g |

The above described dispersion medium was charged in a 5,000 ml separable flask equipped with a stirring device, a temperature sensor, a cooling tube, and a nitrogen induction device, and while stirring at a stirring rate of 230 rpm under a nitrogen flow, a temperature of the flask was increased to 80° C.

| | |
|---|---|
| Styrene | 612 g |
| n-butyl acrylate | 156 g |
| Methacrylic acid | 32 g |
| n-octyl mercaptan | 13 g |

An initiator solution prepared by dissolving 9.62 g of a polymerization initiator (potassium persulfate) in 200 g of ion exchange water was added to this activator solution, thereto was added dropwise the above described monomer solution over 90 minutes, and the system was heated and stirred at 80° C. over 2 hours, to perform polymerization (the first stage polymerization) to prepare a latex. This is referred to as "latex (1L)". T1/2 of the dried latex (1L) was 124° C.

Preparation of Latex 1HML (1) Preparation of Core Particles (The First Stage Polymerization)

| (Dispersion medium 1) | |
|---|---|
| Sodium dodecyl sulfate | 4.05 g |
| Ion exchange water | 2,500.00 g |

The above described dispersion medium 1 was charged in a 5,000 ml separable flask equipped with a stirring device, a temperature sensor, a cooling tube, and a nitrogen induction device, and while stirring at a stirring rate of 230 rpm under a nitrogen flow, a temperature of the flask was increased to 800° C.

| | |
|---|---|
| Styrene | 568.00 g |
| n-butyl acrylate | 164.00 g |
| Methacrylic acid | 68.00 g |
| n-octyl mercaptan | 16.51 g |

An initiator solution prepared by dissolving 9.62 g of a polymerization initiator (potassium persulfate) in 200 g of ion exchange water was added to this activator solution, thereto was added dropwise the above described monomer solution over 90 minutes, and the system was heated and stirred at 80° C. over 2 hours, to perform polymerization (the first stage polymerization) to prepare a latex. This is referred to as "latex (1H)". A weight average particle diameter of the latex (1L) was 68 nm.

(2) Formation of Intermediate Layer (The Second Stage Polymerization)

| (Monomer solution 2) | |
|---|---|
| Styrene | 123.81 g |
| n-butyl acrylate | 39.51 g |
| Methacrylic acid | 12.29 g |
| n-octyl mercaptan | 0.72 g |
| Paraffin wax | 75.0 g |

In a flask equipped with a stirring device, the above described monomer solution 2 was charged, and heated to 80° C., and dissolved to prepare a monomer solution.

| (Dispersion medium 2) | |
|---|---|
| $C_{10}H_{21}(OCH_2CH_2)_2OSO_3Na$ | 0.60 g |
| Ion exchange water | 2,700.00 g |

On the other hand, the dispersion medium 2 was heated to 98° C., and this dispersion medium was added with 32 g in terms of a solid content of the above described latex (1H) that is a dispersion medium of core particles, then, the monomer solution 2 was mixed and dispersed for 8 hours by a mechanical dispersing machine having a circulation route, "CLEARMIX" (manufactured by M Technique Co., Ltd.) to prepare a dispersion (emulsion) containing emulsified particles (oil drop).

Subsequently, an initiator solution prepared by dissolving 6.12 g of a polymerization initiator (potassium persulfate) in 250 ml of ion exchange water was added to this dispersion (emulsion), and then the system was heated and stirred at 82° C. over 12 hours, to perform polymerization (the second stage polymerization) to obtain a latex (a dispersion of complex resin particles having a structure in which surfaces of latex (1H) particles were coated). This is referred to as "latex (1HM)".

(3) Formation of Outer Layer (The Third Stage Polymerization)

| (Monomer solution 3) | |
|---|---|
| Styrene | 350 g |
| n-butyl acrylate | 95 g |
| Methacrylic acid | 5 g |
| n-octyl mercaptan | 6.1 g |

To the latex (1HM) obtained in the above described manner, an initiator solution prepared by dissolving 8.8 g of a polymerization initiator (KPS) in 350 ml of ion exchange water was added, and thereto was added dropwise the monomer solution 3 over 1 hour under a condition of a temperature at 82° C. After completion of addition, polymerization (the third stage polymerization) was initiated by heating and stirring over 2 hours, and then the system was cooled to 28° C. to obtain a latex (a dispersion of a complex resin, having the core made of latex (1H), the intermediate layer made of the second stage polymerization resin, and the outer layer made of the third stage polymerization resin, in which a wax was contained in the second stage polymerization resin layer). This latex is referred to as a "latex (1HML)". An amount of the wax W1 contained in the latex (1HML) was 12.5% by mass based on the monomer, and T1/2 of the dried latex (1L) was measured and found to be 131° C.

<Preparation of Toner Particles in Emulsion Polymerization Method>

A reaction container (four-neck flask) equipped with a temperature sensor, a cooling tube, a nitrogen induction device, and a stirring device was charged with 240.0 g (in terms of a solid content) of latex (1L), 180.0 g (in terms of a solid content) of a latex (1HML), 900 g of ion exchange water, and 150 g of the above described cyan coloring agent dispersion, and the mixture was stirred. The temperature of the container was adjusted to 30° C., and then a 5N aqueous sodium hydroxide solution was added to this mixture to adjust pH to 8 to 10.0.

Subsequently, an aqueous solution prepared by dissolving 65.0 g of magnesium chloride hexahydrate in 1,000 ml of ion exchange water was added at 30° C. over 10 minutes under stirring. After leaving for 3 minutes, the temperature was increased to 92° C., and production of coagulated particles was performed. In the state, particle diameters of the coagulated particles were measured by a "Coulter Counter TA-II", and at the time when a number average particle diameter became 6.6 μm, an aqueous solution obtained by dissolving 80.4 g of sodium chloride in 1,000 ml of ion exchange water was added thereto to terminate particle growth, and further as an aging treatment, the reaction solution was heated and stirred at a solution temperature of 94° C., to continuously perform fusion of particles and phase separation of crystalline substances (aging step). In the state, a shape of the fused particle was measured by "FPIA-2000", and at the time when a shape factor became 0.952, the temperature was cooled to 30° C., and stirring was terminated. The produced fused particle was filtered, repeatedly washed with ion exchange waster at 45° C., and then by drying with warm air at 40° C., a toner (c) was obtained. The average particle diameter and a shape factor of the toner (c) were measured again and found to be respectively 6.5 μm and 0.954.

T1/2 measured by a capillary constant load extrusion rheometer was 127° C.

Furthermore, in the production step of the toner (c), a time for the step of aging particles was extended, and a toner base (d) having an average particle diameter of 6.6 μm and a circularity of 0.990 was obtained.

(Preparation of Toner Particles in Dissolution Suspension Extension Method)

(Synthesis of Organic Fine Particle Emulsion)

A reaction container in which a stirrer and a thermometer were set was charged with 683 parts of water, 11 parts of sodium salt of sulfuric acid ester of methacrylic acid ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulfate, the mixture was stirred at 3,800 rpm for 30 minutes to obtain a white emulsion. The temperature of the system was increased to 75° C. by heating to react for 4 hours. Further, thereto was added 30 parts of an aqueous 1% ammonium persulfate solution, and the reaction mixture was aged at 75° C. for 6 hours to obtain an aqueous dispersion (fine particle dispersion 1) of a vinyl resin (copolymer of styrene, methacrylic acid, butyl acrylate, and sodium salt of sulfuric acid ester of methacrylic acid ethylene oxide adduct). A volume average particle diameter of the "fine particle dispersion 1" measured by LA-920 was 110 nm. A part of the "fine particle dispersion 1" was dried and a resin content was isolated. Tg of the resin content was 58° C., and a weight average molecular weight was 130,000.

(Preparation of Aqueous Phase)

Water in an amount of 990 parts, 83 parts of the "fine particle dispersion 1", 37 parts of an aqueous solution of 48.3% dodecyl diphenyl ether sodium disulfonate (ELEMINOL MON-7; manufactured by Sanyo Chemical Industries, Ltd.), and 90 parts of ethyl acetate were mixed and stirred, and a milky white aqueous solution was obtained. This is referred to as "aqueous phase 1".

(Synthesis of Low Molecular Weight Polyester)

A reaction container equipped with a cooling tube, a stirring device and a nitrogen induction tube was charged with 229 parts of an ethylene oxide 2 mol adduct of bisphenol A, 529 parts of a propylene oxide 3 mol adduct of bisphenol A, 208 parts of terephthalic acid, 46 parts of adipic acid, and 2 parts of dibutyltin oxide, the mixture was reacted at 230° C. under normal pressure for 7 hours, and further reacted under reduced pressure of 10 to 15 mmHg for 5 hours, then 44 parts of trimellitic anhydride was charged in the reaction container, and the mixture was reacted at 180° C. under normal pressure for 3 hours to obtain "low molecular weight polyester 1". The "low molecular weight polyester 1" had a number average molecular weight of 2,300, a weight average molecular weight of 6,700, Tg of 43° C., and an acid value of 25.

(Synthesis of Intermediate Polyester)

A reaction container equipped with a cooling tube, a stirring device and a nitrogen induction tube was charged with 682 parts of an ethylene oxide 2 mol adduct of bisphenol A, 81 parts of a propylene oxide 2 mol adduct of bisphenol A, 283 parts of terephthalic acid, 22 parts of trimellitic anhydride, and 2 parts of dibutyltin oxide, the mixture was reacted at 230° C. under normal pressure for 7 hours, and further reacted under reduced pressure of 10 mmHg to 15 mmHg for 5 hours to obtain "intermediate polyester 1". The "intermediate polyester 1" had a number average molecular weight of 2,200, a weight average molecular weight of 9,700, Tg of 54° C., an acid value of 0.5, and a hydroxyl value of 52.

Then, a reaction container equipped with a cooling tube, a stirring device and a nitrogen induction tube was charged with 410 parts of the "intermediate polyester 1", 89 parts of isophorone diisocyanate, and 500 parts of ethyl acetate, and the mixture was reacted at 100° C. for 5 hours to obtain "prepolymer 1". The "prepolymer 1" had % by weight of isolated isocyanate of 1.53%.

(Synthesis of Ketimine)

A reaction container in which a stirrer and a thermometer were set was charged with 170 parts of isophorone diamine and 75 parts of methyl ethyl ketone, and a reaction was carried out at 50° C. for 4 and half hours to obtain a "ketimine compound 1". An amine value of the "ketimine compound 1" was 417

(Synthesis of Master Batch (MB))

Water in an amount of 1,200 parts, 540 parts of carbon black (Printex 35 manufactured by Degussa Co.) [DBP oil absorption amount of 42 ml/100 mg, pH of 9.5], and 1,200 parts of a polyester resin were added, and mixed by a Henschel mixer (manufactured by MITSUI MINING COMPANY, LIMITED), and the mixture was kneaded at 130° C. with two rolls for 1 hour, then rolled and cooled, and pulverized by a pulverizer to obtain a "master batch 1".

(Preparation of Oil Phase)

A reaction container in which a stirrer and a thermometer were set was charged with 378 parts of the "low molecular weight polyester 1", 100 parts of carnauba wax, and 974 parts of ethyl acetate, the temperature was increased to 80° C. under stirring, and after keeping at 80° C. for 5 hours, cooled to 30° C. over 1 hour. Then, the container was charged with 500 parts of the "master batch 1" and 500 parts of ethyl acetate, and mixed for 1 hour to obtain a "material dissolution solution 1".

The "material dissolution solution 1" in an amount of 1,324 parts was transferred to a container, and dispersion of carbon black and wax was performed using a bead mill (Ultraviscomill, manufactured by Aimex Co., Ltd.), under the conditions of a solution feed rate of 1 kg/hr, a disc peripheral velocity of 6 m/sec, filled with 0.6 mm zirconium beads at 80% by volume, and 3 passes. Subsequently, thereto was added 1,324 parts of a 65% ethyl acetate solution of the "low molecular weight polyester 1", and by a bead mill with 2 passes under the above conditions, "pigment wax dispersion 1" was obtained. A solid content concentration (130° C., 30 min) of the "pigment wax dispersion 1" was 50%.

(Emulsification→Desolvation)

749 parts of the "pigment wax dispersion 1", 115 parts of the "prepolymer 1" and 2.9 parts of the "ketimine compound 1" were charged in a container, and mixed at 5,000 rpm using TK Homomixer (manufactured by Tokushu Kika Kogyo Co., Ltd.) for 2 minutes, and then 1200 parts of the "aqueous phase 1" was added to the container, and mixed at a rotation speed of 13,000 rpm using TK Homomixer for 25 minutes to obtain "emulsion slurry 1".

A reaction container in which a stirrer and a thermometer were set was charged with the "emulsion slurry 1", and after the solvent was removed at 30° C. for 8 hour, aging was carried out at 45° C. for 7 hours to obtain "dispersion slurry 1".

(Washing→Drying)

After 100 parts of the "dispersion slurry 1" filtered under reduced pressure, (1) 100 parts of ion exchange water was added to the filtration cake, and mixed using TK Homomixer (rotation speed of 12,000 rpm for 10 minutes), and then the mixture was filtered.

(2) To the filtration cake described in (1) was added with 100 parts of an aqueous 10% sodium hydroxide solution, and mixed using TK Homomixer (rotation speed of 12,000 rpm for 30 minutes), and then the mixture was filtered under reduced pressure.

(3) To the filtration cake described in (2) was added with 100 parts of 10% hydrochloric acid, and mixed using TKC Homomixer (rotation speed of 12,000 rpm for 10 minutes), and then the mixture was filtered.

(4) To the filtration cake described in (3) was added with 300 parts of ion exchange water, and mixed using TX Homomixer (rotation speed of 12,000 for 10 minutes), and then filtering operation was performed twice to obtain a "filtration cake 1".

The "filtration cake 1" was dried by a circulation dryer at 45° C. for 48 hours, and passed through a sieve with 75 μm mesh to obtain a toner base particle (e). The toner (e) had an average particle diameter of 5.8 μm, a circularity of 0.960, and a softening point T1/2 of 108° C.

External additives shown in Table 1 were used.

TABLE 1

| | Silica | Surface treatment agent | BET specific surface area ($m^2/g$) |
|---|---|---|---|
| External Additive 1 | H20TM (Clariant (Japan) K.K.) | HMDS | 180 |
| External Additive 2 | TG811F (CABOT Co.) | HMDS | 250 |
| External Additive 3 | Silica base #50 (NIPPON AEROSIL CO., LTD.) | HMDS | 45 |
| External Additive 4 | Silica base #90 (NIPPON AEROSIL CO., LTD.) | HMDS | 70 |

As shown in Table 2, respective external additives and inorganic particles were added to the toner base particles, and mixed by a Henschel mixer, the mixture was sieved with an oscillation sieve machine to obtain toners, and properties of the respective toners are shown in Table 2.

TABLE 2

| | Toner | Toner base | Manufacturing method | External additive Type | External additive Amount (part by mass) | External additive Type | External additive Amount (part by mass) | Toner physical properties: Average particle diameter (μm) | Circularity (—) | Torque (mNm) | Space ratio (%) |
|---|---|---|---|---|---|---|---|---|---|---|---|
| Example. | 1 | a | Pulverization | 1 | 1.0 | 3 | 2.0 | 8.0 | 0.922 | 2 | 57 |
| | 2 | c | Polymerization | 1 | 1.0 | 3 | 2.0 | 6.5 | 0.954 | 1.8 | 55 |
| | 3 | e | Polymerization | 1 | 1.0 | 3 | 2.0 | 5.8 | 0.96 | 1.3 | 55 |
| | 4 | a | Pulverization | 2 | 1.0 | 4 | 2.0 | 8.0 | 0.922 | 1.5 | 58 |
| Comparative. | 5 | b | Pulverization | 1 | 1.0 | 3 | 2.0 | 8.5 | 0.918 | 3.3 | 55 |
| Example. | 6 | d | Polymerization | 2 | 3.0 | — | — | 6.6 | 0.99 | 0.9 | 54 |

The toner transporting belt 61 of the embodiment in the present invention transports a waste toner in a lower transportation route (a region where the external peripheral surface of the toner transporting belt 61 faces the bottom surface of the toner transporting duct 64) between two transportation routes of sending the waste toner in the lower part to the upper part by rotating in the A direction shown in the figure.

61 in the direction opposing to the A direction shown in the figure. A toner recovery apparatus having the toner transporting belt 61 with a width of 8 (mm), a height of the convex part of 2 (mm), the number Z of the convex parts of 24, a pitch of the convex part of 15.7 (mm), inner peripheral length of 276 (mm), and a diameter of a driving roller of 5 (mm) was used. Using an external driving equipment so as to freely change an

TABLE 3

| | Toner | Toner torque | Slope angle of toner transport duct (Horizontal plane = 0°) | Toner tranporting route (upper route/ lower route) | Evaluation of toner recovery apparatus: Toner transporting rate (g/min) At 40 rpm | Toner transporting rate (g/min) At 100 rpm | Toner spillage | Motor driving torque anomaly |
|---|---|---|---|---|---|---|---|---|
| Ex. 1 | 1 | 2 | 50 | lower route | 1.5 | 2.3 | A | A |
| Ex. 2 | 2 | 1.8 | 50 | lower route | 1.3 | 2 | A | A |
| Ex. 3 | 3 | 1.3 | 50 | lower route | 1.1 | 1.8 | A | A |
| Ex. 4 | 4 | 1.5 | 50 | lower route | 1.2 | 1.8 | A | A |
| Comp. Ex. 5 | 5 | 3.3 | 50 | lower route | 1.6 | 2.4 | A | C |
| Comp. Ex. 6 | 6 | 0.9 | 50 | lower route | 0.4 | 0.9 | B | A |
| Comp. Ex. 7 | 1 | 2 | 50 | upper route | 0.4 | 1.3 | B | A |
| Comp. Ex. 8 | 2 | 1.8 | 50 | upper route | 0.4 | 1.1 | B | A |
| Comp. Ex. 9 | 3 | 1.3 | 50 | upper route | 0.3 | 0.8 | C | A |
| Comp. Ex. 10 | 4 | 1.5 | 50 | upper route | 0.3 | 0.8 | C | A |
| Comp. Ex. 11 | 5 | 3.3 | 50 | upper route | 1.8 | 2.5 | A | C |
| Comp. Ex. 12 | 6 | 0.9 | 50 | upper route | 0.2 | 0.6 | C | A |
| Ex. 13 | 1 | 2 | 80 | lower route | 1.2 | 1.8 | A | A |
| Comp. Ex. 14 | 5 | 3.3 | 80 | lower route | 1.2 | 2 | A | C |
| Comp. Ex. 15 | 6 | 0.9 | 80 | lower route | 0.3 | 1.6 | C | A |
| Ex. 16 | 1 | 2 | 40 | lower route | 2 | 2.7 | A | A |
| Ex. 17 | 2 | 1.8 | 40 | lower route | 1.5 | 2.2 | A | A |
| Ex. 18 | 3 | 1.3 | 40 | lower route | 1.4 | 2 | A | A |
| Ex. 19 | 4 | 1.5 | 40 | lower route | 1.3 | 2.1 | A | A |
| Comp. Ex. 20 | 5 | 3.3 | 40 | lower route | 2 | 2.8 | A | B |
| Comp. Ex. 21 | 6 | 0.9 | 40 | lower route | 1 | 1.7 | B | A |
| Comp. Ex. 22 | 1 | 2 | 90 | lower route | 0.3 | 0.6 | C | A |
| Comp. Ex. 23 | 5 | 3.3 | 90 | lower route | 0.5 | 1.2 | C | C |
| Comp. Ex. 24 | 6 | 0.9 | 90 | lower route | 0 | 0.1 | C | A |

Evaluation criteria for toner spillage and motor driving torque anomaly are as follows:

"A" Excellent

"B" Slightly below allowable level

"C" Significantly below allowable level

Table 3 shows results of examining transportation amounts when transporting a waste toner in the lower transportation route (lower transportation) by rotating the toner transporting belt 61 in the A direction shown in the figure and when transporting a waste toner in the upper transportation route (upper transportation) by rotating the toner transporting belt angle of the device, respective toner transportation amounts were examined at angles of the slope of the toner transporting duct 64 shown in Table 3.

As shown in this result, in the case where the slope angle of the toner transporting duct 64 was the same, it was found that transporting a waster toner in the lower transportation route sent a larger toner transportation amount than in the upper transportation route. When transporting the waste toner in the upper transportation route, the waste toner is supported on the toner transporting belt 61, and transported with being held on the outer circumferential surface and the convex parts 61*a* of the toner transporting belt 61. Therefore, oscillation of the belt caused at the time of penetrating pins 62*a* through long pores 61*b* of the toner transporting belt 61 and the like is transmitted to the supported waste toner, and the waste toner is spilled down from a gap between the internal wall of the toner transporting duct 64 and the convex parts 61*a*. On the other hand, when the waste toner is transported in the lower transportation route, the waste toner is transported by being held with the internal wall of the toner transporting duct 64 and the convex parts 61*a*. Therefore, oscillation of the belt transmitted to the waste toner is only from the convex parts. Thus, in this case, transmission of oscillation to the waste toner is low as compared with the case of transportation through the upper transportation route. As a result, in the case of the lower transportation, toner spillage hardly occurs in the route, and a toner transportation amount is considered to be larger in the case of lower transportation.

While waster toner is likely to spill down from long pores in the case of upper transportation, no toner spillage occurs from long pores in the case of lower transportation. This may contribute to increased toner transportation amounts in the lower transportation.

On the other hand, it was established that when the slope angle of the toner transporting duct 64 is made large, the toner transportation amount significantly differs depending on the type of toner employed; when the slope angle of the toner transporting duct 64 is set at 90 degrees, a value greater than 85 degrees, significant transportation amount decrease was observed on every kind of toner. Thus, it was found that it is not preferable to set the slope angle of the toner transporting duct 64 to 90 degrees.

As described above, in the toner recovery apparatus of the embodiment of the present invention, occurrence of toner spillage can be prevented since an adverse effect of oscillation of the toner transporting belt 61 can be reduced, as compared with a case where a waste toner is transported by being supported on the toner transporting belt 61. With reduced oscillation, also in a process cartridge and an image forming apparatus which are provided with this toner recovery apparatus, toner spillage can be prevented upon transportation of waste toner. Furthermore, particularly where it is inevitable to employ a configuration in which the toner transporting duct 64 should be steep as in a vertical process cartridge, prevention of toner spillage even in such a steep duct configuration provides a greater latitude for machine design, leading to machine miniaturization.

What is claimed is:

1. A toner recovery apparatus comprising:

a toner transporting duct which is provided in a lower portion thereof with an inlet through which a residual toner removed by a cleaning unit is transported and which is provided in an upper portion thereof with an outlet from which the residual toner is sent to a toner recovery part; and an endless toner transporting belt having a plurality of convex parts on an outer circumferential surface thereof, the belt rotatably stretched in the toner transporting duct;

wherein the toner recovery apparatus transports the residual toner removed by the cleaning unit to the toner recovery part, the toner transporting belt is rotated in a loop form in such a way that the toner transporting belt descends in a region where the outer circumferential surface of the toner transporting belt faces a ceiling surface of the toner transporting duct, and that the toner transporting belt rises in a region where the outer circumferential surface of the toner transporting belt faces a bottom surface of the toner transporting duct, the toner recovery apparatus transports the residual toner transported through the inlet to the outlet by holding the toner by the convex parts, spaces formed between the convex parts and the bottom surface of the toner transporting duct, and the toner comprises a binding resin, a releasing agent, a coloring material, and an external additive, and a torque T (mNm) measured by a torque measurement method using a conical rotor in a space ratio of 50% to 60% is 1.0 to 2.5.

2. The toner recovery apparatus according to claim 1, wherein the bottom surface of the toner transporting duct is inclined with respect to the horizontal plane at an angle of 40 to 85 degrees.

3. The toner recovery apparatus according to claim 1, further comprising in the toner transporting duct a driving roller and a driven roller, wherein the toner transporting belt is stretched between the driving roller and the driven roller.

4. The toner recovery apparatus according to claim 3, wherein the driving roller is provided with convex parts, and the convex parts are engaged with the toner transporting belt so that the toner transporting belt is driven to rotate.

5. The toner recovery apparatus according to claim 4, wherein the toner transporting belt is provided with porous parts or notched parts, and the convex parts of the driving roller are engaged with the porous parts or the notched parts.

6. The toner recovery apparatus according to claim 5, further comprising in the outlet a scraper member for scraping the residual toner transported from the toner transporting belt.

7. The toner recovery apparatus according to claim 1, wherein the toner has an average particle diameter of 5 μm to 10 μm and a circularity of 0.89 to 0.97, and the toner contains a releasing agent having a melting point of 65° C. to 90° C. in an amount of 3 parts by mass to 10 parts by mass, and at least two kinds of inorganic particles added as an external additive.

8. The toner recovery apparatus according to claim 1, wherein the external additive comprises a hydrophobic silica particle A having a BET specific surface area of more than 100 $m^2/g$, and a hydrophobic silica particle B having a BET specific surface area of 30 $m^2/g$ to 100 $m^2/g$.

9. The toner recovery apparatus according to claim 8, wherein the total amount of the silica particle A and the silica particle B added is 2.5 parts by mass or more per 100 parts by mass of a toner base particle, and the amount of the silica particle B is larger than the amount of the silica particle A in the toner.

10. A process cartridge comprising:

a latent electrostatic image bearing member for bearing thereon a latent electrostatic image;

a toner recovery unit configured to transport residual toner of the one-component nonmagnetic toner removed by a cleaning unit to a recovery unit;

at least one unit configured to be supported integrally with a developing device; and a toner recovery apparatus;

wherein the process cartridge is detachably mounted to an image forming apparatus that forms an image by visualizing a latent electrostatic image formed on a latent electrostatic bearing member by use of a one-component nonmagnetic toner, and wherein the toner recovery apparatus comprises a toner transporting duct which is provided in a lower portion thereof with an inlet through which the residual toner removed by the cleaning unit is transported and which is provided in an upper portion thereof with an outlet from which the residual toner is sent to a toner recovery part;

and an endless toner transporting belt having a plurality of convex parts on an outer circumferential surface thereof, the belt rotatably stretched in the toner transporting duct;

wherein the toner recovery apparatus transports the residual toner removed by the cleaning unit to the toner recovery part, the toner transporting belt is rotated in a loop form in such a way that the toner transporting belt descends in a region where the outer circumferential surface of the toner transporting belt faces a ceiling surface of the toner transporting duct, and that the toner transporting belt rises in a region where the outer circumferential surface of the toner transporting belt faces a bottom surface of the toner transporting duct, the toner recovery apparatus transports the residual toner transported through the inlet to the outlet by holding the toner by the convex parts, spaces formed between the convex parts and the bottom surface of the toner transporting duct, and the toner comprises a binding resin, a releasing agent, a coloring material, and an external additive, and a torque T (mNm) measured by a torque measurement method using a conical rotor in a space ratio of 50% to 60% is 1.0 to 2.5.

11. The process cartridge according to claim 10, wherein the toner transporting duct is provided in a side surface of the process cartridge.

12. The process cartridge according to claim 10, wherein the toner recovery part is provided at a position higher than the developing device.

13. An image forming apparatus, comprising:

a latent electrostatic image bearing member for bearing thereon a latent electrostatic image;

a developing device configured to form a toner image by visualizing the latent electrostatic image using a mono-component nonmagnetic toner;

a charging unit configured to charge the latent electrostatic image bearing member;

an exposure unit configured to form a latent electrostatic image on the charged latent electrostatic image bearing member, a transfer unit configured to transfer a toner image formed by the developing device to a recording medium;

a cleaning unit configured to remove residual toner of the mono-component nonmagnetic toner from the latent electrostatic image bearing member;

a toner recovery unit configured to transport the residual toner removed by the cleaning unit to a toner recovery part; and a toner recovery apparatus, wherein the toner recovery apparatus comprises a toner transporting duct which is provided in a lower portion thereof with an inlet through which the residual toner removed by the cleaning unit is transported and which is provided in an upper portion thereof with an outlet from which the residual toner is sent to the toner recovery part; and an endless toner transporting belt having a plurality of convex parts on an outer circumferential surface thereof, the belt rotatably stretched in the toner transporting duct;

wherein the toner recovery apparatus transports the residual toner removed by the cleaning unit to the toner recovery part, the toner transporting belt is rotated in a loop form in such a way that the toner transporting belt descends in a region where the outer circumferential surface of the toner transporting belt faces a ceiling surface of the toner transporting duct, and that the toner transporting belt rises in a region where the outer circumferential surface of the toner transporting belt faces a bottom surface of the toner transporting duct, the toner recovery apparatus transports the residual toner to the outlet by holding the toner by the convex parts, spaces formed between the convex parts and the bottom surface of the toner transporting duct, and the toner comprises a binding resin, a releasing agent, a coloring material, and an external additive, and a torque T (mNm) measured by a torque measurement method using a conical rotor in a space ratio of 50% to 60% is 1.0 to 2.5.

* * * * *